US008943725B2

(12) United States Patent
Gotzy

(10) Patent No.: US 8,943,725 B2
(45) Date of Patent: Feb. 3, 2015

(54) EQUIPMENT FOR DISPLAYING INFORMATION CARRIERS, ESPECIALLY FOR ADVERTISING PURPOSES

(76) Inventor: Andras Gotzy, Torokbalint (HU)

( * ) Notice: Subject to any disclaimer, the term of this patent is extended or adjusted under 35 U.S.C. 154(b) by 0 days.

(21) Appl. No.: 12/998,777

(22) PCT Filed: Apr. 19, 2011

(86) PCT No.: PCT/HU2011/000034

§ 371 (c)(1),
(2), (4) Date: Jun. 11, 2012

(87) PCT Pub. No.: WO2011/132005

PCT Pub. Date: Oct. 27, 2011

(65) Prior Publication Data

US 2013/0026890 A1 Jan. 31, 2013

(30) Foreign Application Priority Data

Apr. 21, 2010 (HU) ..... 1000222
Apr. 18, 2011 (HU) ..... 1100205

(51) Int. Cl.
*G09F 19/00* (2006.01)
*A47F 11/06* (2006.01)
*G09F 19/12* (2006.01)

(52) U.S. Cl.
CPC ..... *A47F 11/06* (2013.01); *G09F 19/12* (2013.01)
USPC ..... 40/800; 119/264; 119/253; 40/538

(58) Field of Classification Search
USPC ..... 119/253; 40/800; 446/219
See application file for complete search history.

(56) References Cited

U.S. PATENT DOCUMENTS 3,910,408 A * 10/1975 Husney et al. ..... 206/0.81
3,919,797 A 11/1975 Murakami
5,180,222 A * 1/1993 Robinson ..... 362/125
5,301,444 A * 4/1994 Horiuchi ..... 40/426
5,704,103 A * 1/1998 Crowley et al. ..... 27/1
5,722,347 A * 3/1998 Tominaga et al. ..... 119/253
5,778,824 A * 7/1998 Musgrave et al. ..... 119/230
5,988,109 A * 11/1999 Rofen ..... 119/245
6,438,878 B1 * 8/2002 Fine et al. ..... 40/409

(Continued)

FOREIGN PATENT DOCUMENTS

DE 35 35 393 A1 4/1987
DE 43 10 760 A1 12/1993

(Continued)

*Primary Examiner* — Charles A Fox
*Assistant Examiner* — Shin Kim
(74) *Attorney, Agent, or Firm* — Olson & Cepuritis, Ltd.

(57) ABSTRACT

Equipment for displaying information carriers, especially for advertising purposes, has a chamber accommodating an information carrying device and constructed to make it possible to look into the internal space of the chamber. The chamber is provided with at least one transparent plate transverse to the direction of viewing. The information carrying device is on this plate. At least a part of the chamber wall has strips parallel to a strip in contact with the transparent plate. The information carrying device is formed by at least two objects situated on opposite sides of the transparent plate.

5 Claims, 17 Drawing Sheets

(56) References Cited

U.S. PATENT DOCUMENTS

| | | | | |
|---|---|---|---|---|
| 6,634,052 | B2 * | 10/2003 | Hanson | 15/220.2 |
| 6,865,771 | B2 * | 3/2005 | Hanson | 15/220.2 |
| D540,505 | S * | 4/2007 | Perreault | D99/5 |
| 8,051,590 | B2 * | 11/2011 | Schnuckle | 40/324 |
| 8,161,909 | B2 * | 4/2012 | Sprung | 119/264 |
| 8,196,275 | B2 * | 6/2012 | Wessel | 27/10 |
| 2006/0174840 | A1 * | 8/2006 | Rafailovich | 119/264 |
| 2010/0024739 | A1 * | 2/2010 | Bakker | 119/264 |
| 2010/0116217 | A1 * | 5/2010 | Allis | 119/264 |
| 2013/0026890 | A1 * | 1/2013 | Gotzy | 312/114 |
| 2013/0284106 | A1 * | 10/2013 | Moewe | 119/253 |

FOREIGN PATENT DOCUMENTS

| | | | |
|---|---|---|---|
| DE | 299 08 819 | U1 | 11/2000 |
| EP | 0 334 196 | A2 | 9/1989 |
| EP | 0 551 059 | B1 | 7/1993 |
| EP | 0 808 594 | A2 | 11/1997 |
| EP | 1 759 373 | B1 | 3/2007 |
| JP | 07-328243 | | 12/1995 |
| WO | WO 2005/064573 | A2 | 7/2005 |

* cited by examiner

EQUIPMENT FOR DISPLAYING INFORMATION CARRIERS, ESPECIALLY FOR ADVERTISING PURPOSES

The invention relates to devices displaying information carriers, especially objects, mainly goods and products, or/and events, such as human, mainly service activities, favourably relating to display equipment for advertising purposes, which has a chamber for accommodating the information carrying device.

The efficiency of advertising goods for sale has an extremely important role in making them marketable and increasing the number of goods sold, that is the achievable profit. For this reason, all over the world specialists dealing with advertising are working on developing advertising techniques, and as a result of their work all types of different solutions are elaborated to enhance the efficiency of advertising.

Different methods of advertising goods—products—are known, for example texts, pictures, films, and their combinations, conveyed to the consumers via the media (newspapers, TV, films, brochures, posters, etc.). One of the most efficient methods is to display the products to be advertised themselves for example on shelves, stands, in glass cabinets, etc. Often they try to enhance the efficiency of display, i.e. advertising, with mirrors and lighting (light intensity, shading, use of light sources of difference colours, for example pulsating or/and moving rays of light, etc.). Patent specification no. EP 0334 196, for example, describes a box-type advertising device, the front wall of which is delimited by a mirror transparent in one direction, and its rear wall is a non-transparent mirror. If it is possible to see inside the box from two sides, then the rear wall is also a mirror transparent from one direction, like the front wall. The mirror surfaces are turned to face the inside of the box. Several lamps are fitted next to the side walls, and due to the mirror surfaces facing each other they these lights look like festoon lighting moving away from the side wall of the box. Tilting the rear mirror gives the impression that the festoon lighting is curved, which attracts attention.

According to patent specification no. DE 3 535 393, the efficiency of advertising is enhanced by placing a pyramidal body made of glass—a refractive prism—above the displayed product, and by showing different pictures of the product, depending on the position of the viewer's eyes.

In the case of the solution according to patent specification no. EP 0 551 059 a closed cabinet is used, the walls of which—except for its door—are made of an opaque material, but the door is made of a mirror transparent from one direction with its mirror surface facing outwards. The internal space of the cabinet is divided into compartments separated by separation walls made of an opaque material, and there is a light in each compartment. These programme-controlled lights are turned on and off separately, so it is always the inside of a different compartment—that is the product placed inside it—that can be seen. It is not possible to see inside the other compartments from outside when the light inside them is not on, as the inside of these compartments is blocked from the viewers by a mirror, that is the door.

Patent specification no. U.S. Pat. No. 5,180,222 also relates to a cabinet with a head plate having a mirror surface facing outwards and formed by a mirror transparent from one direction, which cabinet has the shape of an equilateral triangle in horizontal section. The two walls of this cabinet are formed by mirrors facing inwards. Due to the mirror surfaces the product placed inside the cabinet can be seen from all sides, and these mirror surfaces—depending on the position of the eyes—multiply the image of the object like a kaleidoscope.

Patent specification no. EP 1 759 373 describes equipment for displaying information carriers especially for advertising purposes, which has a chamber suitable for accommodating the given information carrying device. This chamber is delimited by a wall made of a non-transparent material on all sides except for one side. A transparent wall is built in the chamber parallel to the rear wall opposite the opening allowing an inside view of the chamber, at a distance in front of it, along a strip running around, with which the edges of the transparent plate are in contact. The information carrier to be displayed, generally an object, for example a box, the content of which—e.g. foodstuff, cigarettes, cosmetic product—is displayed on its external surface, is fixed to the front side of the transparent plate—looking at it from the direction of the opening of the chamber—, while there is a light source behind the transparent plate. The side wall delimiting the chamber contain strips running parallel to the contact strip of the transparent plate. In this way the linear fixing/fitting place of the transparent plate actually supporting the object is displayed as a member of the group of lines inside the chamber, and if at the same time the transparent supporting plate is lit from the background to avoid any reflection in the chamber as much as possible, the object appears in the space producing the illusion that it is floating without any support or/and suspension. As a result of this viewers are made more interested, their attention is attracted much more intensively than in the case of the advertising methods known before, which obviously enhances the efficiency of advertising significantly.

The task to be solved with the invention is to provide equipment for displaying information carriers especially for advertising purposes, which is based on producing the illusion of floating the information carrier, but significantly increases the attention attracting, first of all advertising efficiency of such known equipment described above.

The invention is based on the following recognitions:

the efficiency and possibilities of use of the known equipment producing the illusion of floating is restricted by the fact that only one side of the chamber is open. We recognised that the illusion of floating the object to be advertised can also be produced with a chamber open on both or several sides or which is even transparent on all sides, if the advertising vehicle is formed by two objects fixed opposite each other on two sides of the transparent plate built in the chamber, covering each other, symmetrically. It can be realised, for example, by cutting the given product in the middle and fixing the two halves to fit on the two sides of the transparent plate, or by positioning them at a slight distance from the transparent plate—disturbing the eyes—fixed to a pin or a pivot built in the glass plate, on which or with which they can even be turned with a motor built into the object. Such a box or chamber open on two sides, or which is even transparent from all sides, allowing the possibility of looking inside it both from the front and from the back significantly increases the efficiency of advertising, as it is possible to walk completely around the chamber, by placing it in the shop-window it attracts people to go inside the shop, as they want to have a look at the advertised product from the other side or sides as well, and so they can find out for sure that the product is not suspended from the back (which they may assume in the case of the box having a rear wall). Another important advantage of the chamber or box transparent or open on two sides is that there is no need for background lighting, it is sufficient for there to be small light fittings placed only in the peripheral area of the sight-holes, or for there to be lighting implemented from outside of, behind the side walls made out of translucent material, with which special effects can be created for to given advertising tasks.

We also recognised that in certain cases of use the space containing the information carrier does not need to be lit at all, if the side walls of the chamber are only partly made of an opaque material, for example their central range, where the transparent plate supporting the information carrying object is built into the chamber open at the front and at the back. In this case, from the openings towards the inside the side walls can be made of a transparent plate distorting the image, e.g.: a plastic (plexi) plate, or a plate roughened or made dull by sand blasting. It also has the advantage that the fitting of the object cut in half cannot be sensed on the glass plate, as a result of which a further astonishing effect can be reached.

We also recognised that—which we have already made reference to—the inventive idea enables us to create a chamber where all the delimiting walls, or at least the majority of the delimiting walls, are made of a transparent material, e.g. glass, allowing viewers to look inside from all directions, and they see the information carrying/advertising device floating. We can use, for example, a square-based chamber the top and bottom of which is made of a non-transparent material, and inside the chamber there is a transparent plate running along the entire length of the chamber in the direction of one of the diagonals, and on the internal surface of the top and bottom made of a non-transparent material there are strips parallel to the plane of the transparent plate, favourable falling in the same plane. For placing and floating the objects there is a shelf inside the chamber, which shelf fits to the surfaces of the transparent sheet opposite each other with identical shelf-part surfaces situated in a way covering each other, producing the illusion of one single shelf floating inside the chamber with the advertised object(s) placed on it. Naturally, it is also possible for every wall of the chamber to be made out of a transparent material.

On the basis of the above recognitions, in accordance with the invention the set task was solved with equipment for displaying information carriers especially for advertising purposes, which has a chamber for accommodating the information carrying device and constructed in a way to make it possible to look into its internal space, in which chamber there is at least one transparent plate transversal with respect to the direction of viewing, attached to the wall of the chamber, and the information carrying device is situated on this plate directly or via a supporting device attached to the transparent plate; and at least a part of the chamber wall contains strips parallel to its strip contacting the transparent plate, and which equipment is characterised by that the information carrying device and/or its supporting device is formed by at least two objects, which are situated on the two sides of the transparent plate opposite each other and the projections of which seen from the direction perpendicular to the transparent plate are identical or basically identical.

Favourably the distance between the viewpoint(s) of the chamber and the transparent plate is chosen to ensure coverage of the transparent plate part fitting between the objects.

According to a favourable construction example the objects forming the information carrying device are fitted on two sides of the transparent plate, or at a distance from the sides fixed to a pin or pivot, in a given case arranged on or with the latter so that they can be rotated with a motor built in the objects.

According to another construction example the chamber wall is formed by two side walls, a top and a bottom; and the side walls and the central parts of the top are made of a non-transparent material, while side wall parts and top parts made of a transparent material—e.g. plastic, or a glass plate made dull by surface milling—are attached to these central side wall parts and central top part on two sides.

It is also favourable, if the chamber is cylindrical and its wall is ring-shaped and made of a transparent material at least along its internal surface, and light sources are built into this wall.

According to another construction example the walls of the upright prismatic or cylindrical chamber are formed by an at least partly transparent side wall and a non-transparent top and bottom, the transparent plate is built in the chamber diagonally or in the direction of the diameter; at least on the bottom and on the top, and in a given case in the side walls or on the side walls of the chamber too, there are strips along the two sides of the contact strip of the transparent plate, running parallel to it. In this case practically the walls of the chamber are formed by four side walls perpendicular to each other, a top made of a non-transparent material and a bottom made of the same material; and at least two of the side walls, or favourably all four side walls are made of a transparent material; the transparent plate is built in the chamber diagonally, so that its lower edge is attached to the bottom and its upper edge is attached to the top; on the bottom and on the top there are strips running along the two sides of the contact strip of the transparent plate, parallel to it.

If the chamber has a circular cylindrical base or a polygonal base, the strips parallel to the contact strip of the transparent plate must also be displayed on the side wall. The situation is the same, if the top is made of a transparent or translucent material. Generally the base of the chamber—glass cabinet—can be optional, with the appropriate arrangement of the strips the floating position of the advertisement displaying device or supporting device can be ensured.

According to another construction example that can be used with all chamber versions described above the supporting device attached to the transparent plate is constructed as a shelf producing the illusion that it is floating, the shelf-members of which are fixed to the two opposite sides of the transparent plate with their front surfaces, in such a way that their surfaces fitted to the plate are identical; and on the shelf-members there are strips running parallel to the plane of the transparent plate, formed by grooves, for example. It is also possible to construct the supporting device attached to the transparent plate as a rod producing the illusion that it is floating, the shelf-members of which are fixed to the two opposite sides of the transparent plate with their front surfaces, in such a way that their surfaces fitted to the plate are identical; and on the rod-members there are strips running parallel to the plane of the transparent plate, formed by grooves, for example. It may also be favourable, if the supporting device is a frame fixed along the edge of the opening made in the transparent plate, which frame is formed by frame-members situated opposite each other on the two sides of the transparent plate, covering each other, and covering the edge of the transparent plate; and in the opening of the transparent plate the information carrying device is attached to one or more edges of the transparent plate and/or to the frame. In respect of this invention, "frame" or "frame-member" means a closed curve shaped body of practically any geometric form, so it can be polygonal, circular or elliptical (as there are traditional picture frames of such shapes).

In the case of a further version of the invention the equipment has a chamber for accommodating the information carrying device and constructed in a way to make it possible to look into its internal space, having walls at least partly made of a non-transparent material, with a transparent plate built into it and attached to the wall, with one or more objects placed on this transparent plate; and this equipment is characterised by that it has a chamber with a side wall made of a non-transparent material making it possible to look into its internal space from above, in which chamber a transparent plate transversal or favourably perpendicular to the plane or/and the generatrices of the side wall is attached at a distance from the lower and upper edge of the chamber walls, and identical or generally identical strips are created along its two sides running at a distance parallel to its strip contacting the side wall; and the information carrying device is placed on the transparent plate. According to a favourable construction example this equipment has a chamber of the shape of an upright cylinder, favourably having a circular base, the opening of which through which it is possible to look inside it is covered with a top made of a transparent material in a given case, and which chamber, favourably, has a bottom made of a non-transparent material. Practically the strips are formed by grooves cut into the internal surface of the side wall, and the transparent plate is fitted into one of the intermediate grooves. We intend to emphasise that in the case of this equipment the chamber can be shaped other than like a cylinder, for example it can have the shape of a quadratic or polygonal prism or it can have a triangular base, or it can be composed of curved wall sections, etc., and in this case too a frame surrounding the opening in its transparent plate can be constructed as a supporting device in the transparent plate, to which frame the information displaying device is attached.

The subject of the invention also relates to equipment for displaying information carriers, especially for the purpose of advertising, which equipment has a chamber serving to accommodate the information-carrying device and which is set up in such a way to permit viewing of its internal space, to the wall of which there is a transparent plate fixed on which the information-carrying device is located, and the essence of this equipment is that the information-carrying device and/or its supporting device is formed of at least two objects that are located on two opposing sides of the transparent plate, and their projection viewed from the perpendicular direction to the transparent plate is the same or essentially the same; and that all walls of the chamber are made of a transparent material, and the transparent plate runs through the chamber at an angle, running diagonally from one of its lower edges connecting to its upper edge on the opposite side; the object attached to the transparent plate is formed by the shelf, serving, for example, to accommodate the advertised goods, consisting of the shelf-members located opposite one another on the two sides of the plate; and for the fixing of the transparent plate there are strips formed in a lateral direction as compared to the strips appearing as a result of the grooves formed in the chamber side walls, favourably perpendicular to them; or parallel with them and which strips have the same appearance as them, which, at least in the case of the lateral strips, fall in the same line as such strips formed in the side surface of the shelf.

According to another feature of the invention there are several transparent plates arranged in the chamber, parallel to one another and at a distance from one another, to which one or more information-carrying devices are attached.

Finally, an embodiment of the equipment may be practical in which the strips parallel to the connection strip of the transparent plate on the internal surfaces of the chamber are constructed as the strips of the connections of frame elements fitting to one another in the interior of the chamber; and favourably the frame elements fitted to the transparent plate are clamped to it.

Below the invention is described in detail on the basis of the attached drawings showing favourable constructions of the equipment. In the drawings FIG. 1 shows a construction of the equipment in schematic perspective view;

Figure 26:
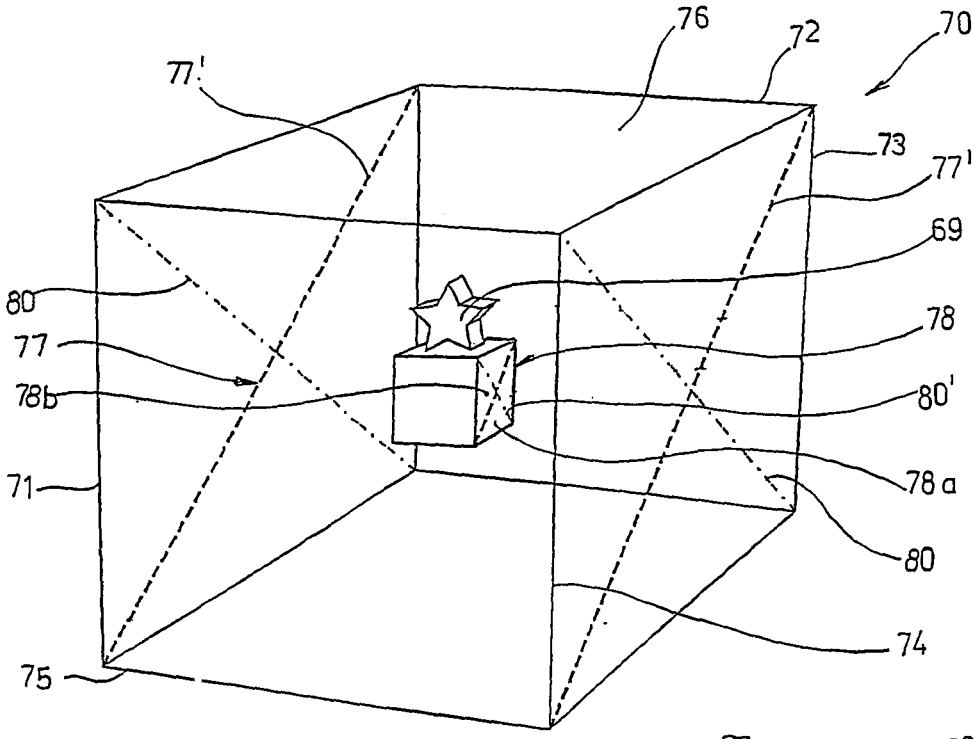
FIG. 26 shows an embodiment of the equipment in perspective view where all walls of the chamber are transparent.
Figure 27:
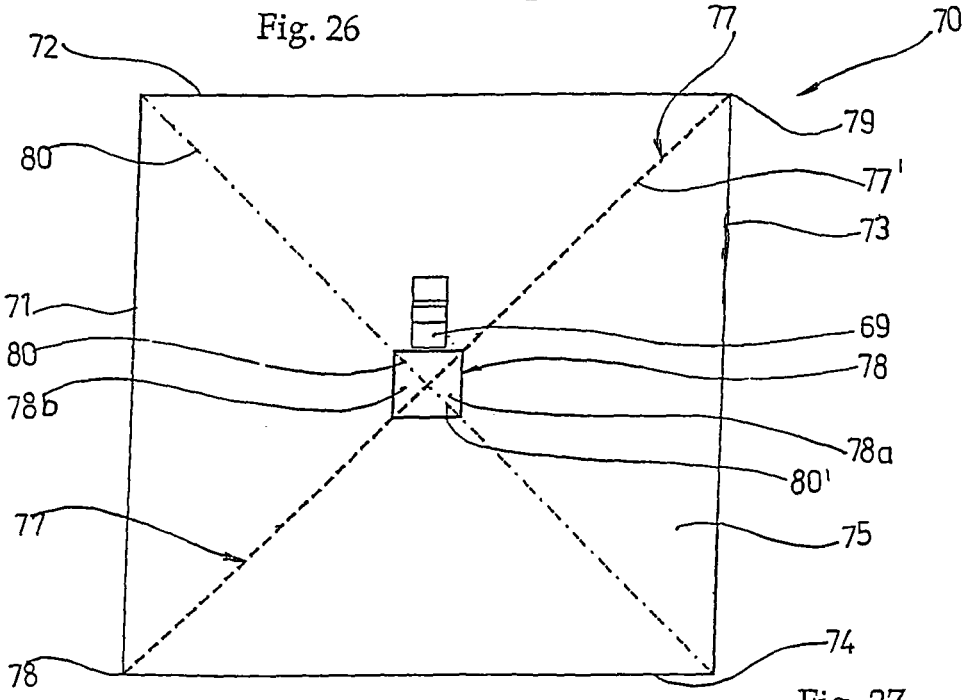
Figure 29:
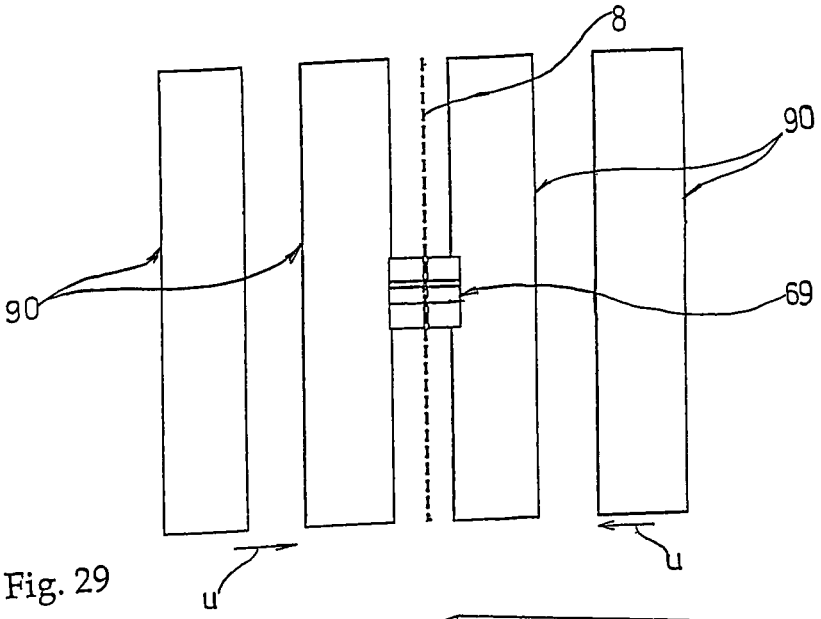
Figure 28:
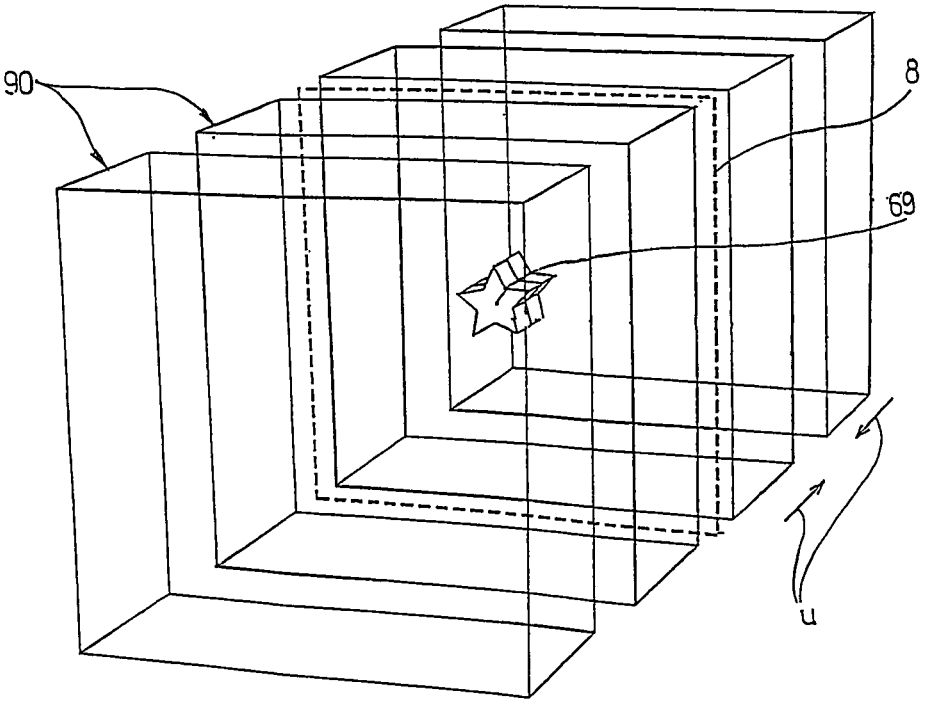
Figure 30:
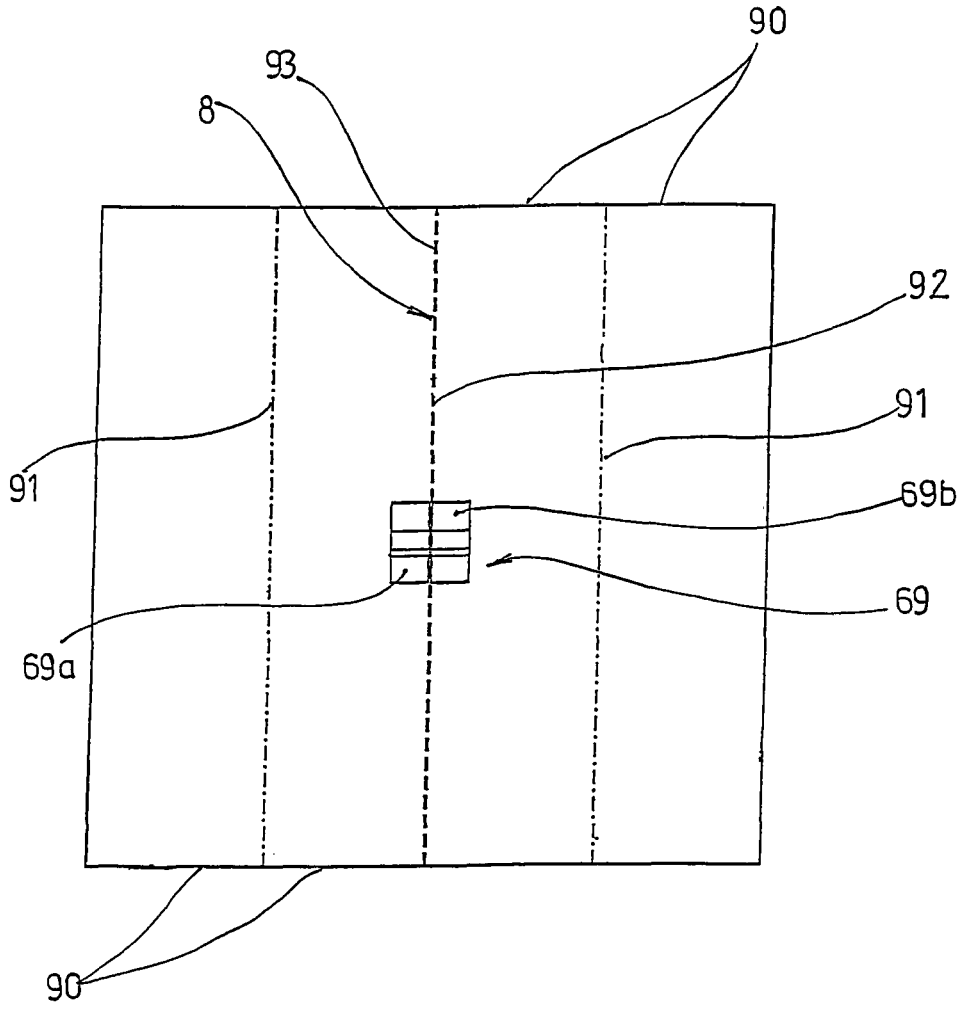

FIG. 27 the equipment according to FIG. 26 in side view;

FIG. 28 a structure shown in perspective view with the help of which the strips parallel to the fitting strip of the transparent plate have been formed as the fitting strips of the frames located inside the chamber;

FIG. 29 the side view of FIG. 28 viewed from the inside;

FIG. 30 we have illustrated the frames visible in FIG. 30 viewed from this side in their position fitting to one another.

Figure 1:
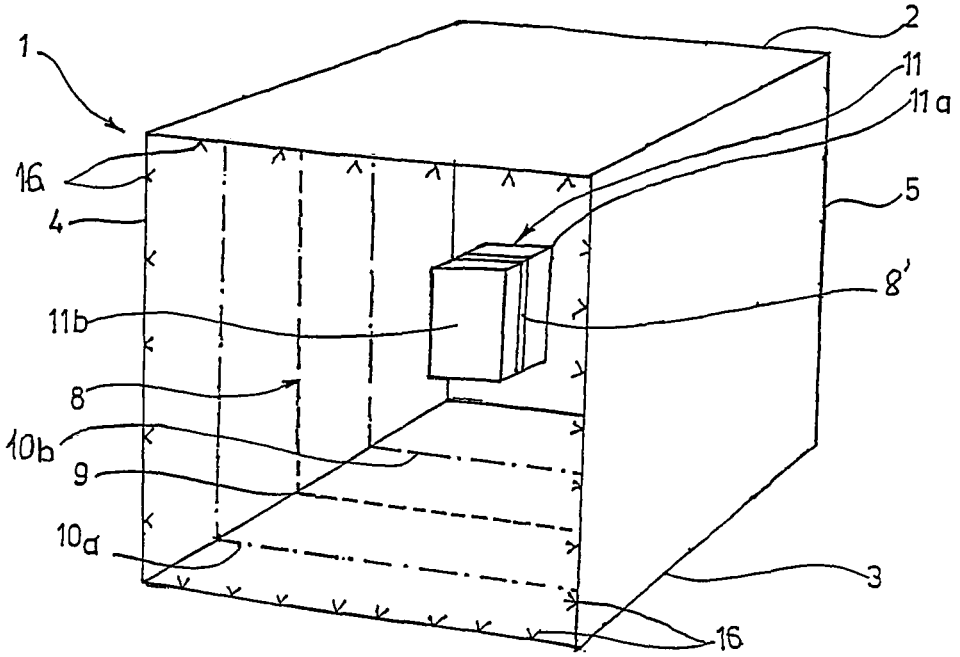
Figure 2:
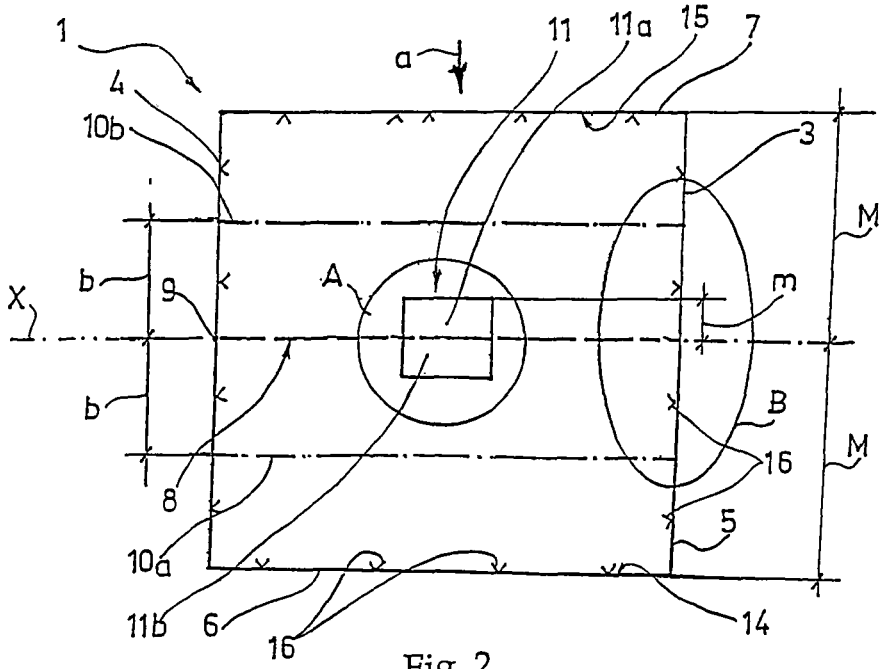
FIG. 2 shows the equipment as in FIG. 1, with the top of the chamber removed, in top view, at a slightly larger scale.

As it can be seen in FIGS. 1 and 2, according to this construction example the equipment has a chamber 1 or box or cabinet of the shape of a rectangular prism, the walls of which are formed by top 2, a bottom 3 (bottom wall) and side walls 4, 5 made of a non-transparent material, e.g. wooden or plastic plate, similarly to the top 2 and the bottom 3. According to this example the ends of the chamber 1 perpendicular to the side walls 4, 5 are closed with transparent end plates 6, 7, e.g. made of glass, which, however, are not necessary in theory from a functional aspect, basically they are to prevent unauthorised access to the inside of the chamber 1 by hand through the end face openings 14, 15, obviously ensuring the possibility of looking inside the chamber 1 from the direction of arrows a (FIG. 2) from two sides, through the openings 14, 15.

In accordance with the invention, in the X vertical central plane of the chamber 1*a* transparent plate 8 is fixed, covering the entire vertical cross section of the chamber, at right angles to the side walls 4,5 and the top 2 and the bottom 3, which transparent plate 8 can be made for example of plate-glass, especially favourably invisible glass available in commercial distribution e.g. under the brand name CONTURAN or MIROGARD, the advantage of which is that it provides additional safety against the risk of possible reflections from the transparent plate 8.

Figure 4:
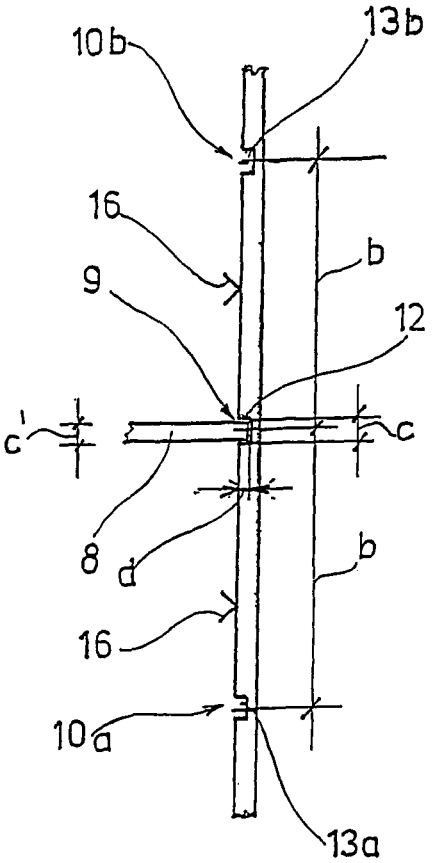
FIG. 4 shows section B marked in FIG. 2, at a larger scale.

As it can be seen in FIG. 4 at a larger scale, the transparent plate 8 fits in and is caught in the groove 12 cut into the top 2, side walls 4, 5 and bottom 3 of the chamber (1) running around continuously.

As the strip 9 along which the edges of the rectangular transparent plate 8 fit into the groove 12 can be visually perceived by the viewer looking inside the chamber 1 from the direction of arrows a through the openings 14, 15 (FIG. 2), on the internal surface of the chamber 1, along the two sides of the groove 12 of the transparent plate 8, at the same b distance from them, strips 10*a*, 10*b* are made parallel to the strip 9 and of the same width, covering the side walls 4, 5, the top 2 and the bottom 3—that is all the walls—, in the form of grooves 13*a*, 13*b* shown in FIG. 4 in the case of this construction example, the d depth and c width of which (FIG. 4) is the same as the depth and width of the groove 12 of the transparent plate 8. As a result of this the viewer looking inside the chamber 1 does not perceive that a transparent plate fits into one of these grooves, namely groove 12, as due to its transparency the viewer finds that groove 12 is identical to grooves 13*a*, 13*b* running parallel to it, in other words the viewer seen only three identical strips 9, 10*a*, 10*b* without perceiving the presence of the transparent plate 8. It is pointed out here that instead of grooves 13*a*, 13*b*, strips 10*a*, 10*b* can be made in a different way too, e.g. by painting, and instead of groove 12 the edges of the transparent plate 8 can be fixed to the internal surfaces of the chamber wall for example with glued lamellas; in this case, obviously strips 10*a*, 10*b* must be formed by a structure suiting it exactly to make the fixture of the transparent plate 8 quasi invisible. It is also pointed out that along the two sides of the strip 9 of the transparent plate 8 more than one strips 10*a*, 10*b* can be created on each side. Furthermore, the neighbouring strips do not need to run along the sides at the same distance.

Figure 3:
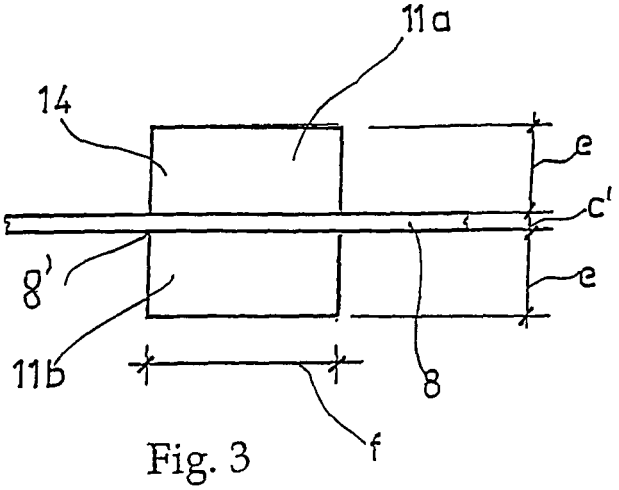
FIG. 3 shows section A marked in FIG. 2, at a larger scale.

According to the invention the information carrying device marked with reference number 11 as a whole is constructed from two objects 11*a*, 11*b*, which are attached to the two opposing sides of the transparent plate 8, in its central range according to this example, as shown in FIG. 3 at a larger scale. According to this the rectangular solid shaped objects 11*a*, 11*b* are completely identically in respect of their dimensions, that is their m height (FIG. 2), their e width and f length on the one part, while on the other part they are attached, e.g. by glued, to the two sides of the transparent plate 8 exactly overlapping each other, in the transparent plate position 18, as it can be seen in FIGS. 1-3. If the M distance measured between the chamber 1 and the transparent plate 8 in the middle, that is the depth of the chamber-half, is chosen so that the part 8' of the thin transparent plate 8 between the objects 11*a*, 11*b*, which is shown in FIG. 1 only for better understanding, cannot be seen by the viewer looking inside the chamber through the opening 14 or 15 even if the viewer looks at the information carrying device 11 at an angle, it appears to be in one piece, as one single element—although it is formed by two parts of a solid cut into half—, so that when looking into the chamber either from one or another direction, the viewer sees it floating.

Figure 5:
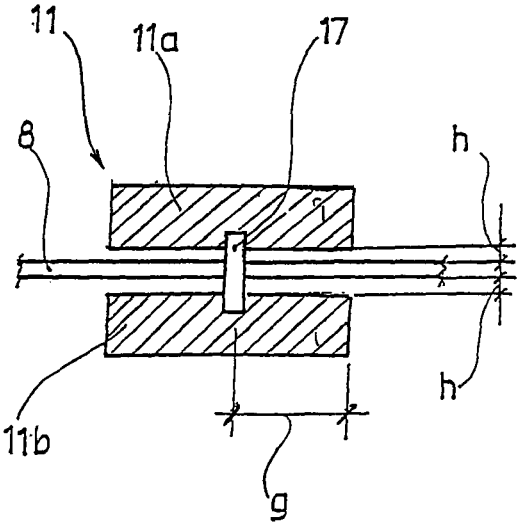
FIG. 5 shows a possible way of connecting the information carrying object to be displayed to the transparent plate, other than what is shown in FIG. 3, in horizontal section.

As it is shown in FIG. 5, this illusion that the information displaying device 11 is floating can also be produced, if the objects 11*a*, 11*b* are not fixed on the transparent plate 18 but are situated at slight distances h from its surfaces, fixed to a pin 17 embedded in the transparent plate 18 in a fixed position, protruding from it on two sides. When choosing the size of the h distances—slot widths—the M width of the cabinet 1 mentioned above must also be taken into consideration to make sure that the viewer cannot see the slot, that is it must be covered by the objects 11*a*, 11*b* even if the viewer looks through the openings 14, 15 on the front side at an angle, from a slightly lateral direction. The size of the M width and the f distances needed to ensure the illusion of floating can be determined simply, e.g. by modelling. It is pointed out here that in this case too the objects 11*a*, 11*b* must overlap each other completely in a view perpendicular to the transparent plate 18, that is on the two sides of this plate the projection of the objects 11*a*, 11*b* seen from this direction is identical.

The solution according to FIG. 5 is especially favourable from the aspect that if the objects 11*a*, 11*b* are connected to the pin 17 in a rotatable way, e.g. with bearings, they can be rotated with the help of motors built in the objects, which may significantly increase the efficiency of advertising. The glass plate may also be rotated, and moved up and down and laterally in any chosen direction.

As the chamber 1 of the equipment shown in FIGS. 1-5 is delimited by non-transparent walls on four sides, its internal space, namely the information carrying device 11 must be illuminated, which, in the case of this construction example, is realised with the help of light sources 16, e.g. LED light fittings, attached to the side walls 4, 5 and to the bottom 3 and the top 2 in the peripheral environment of the openings 14, 15.

Figure 6:
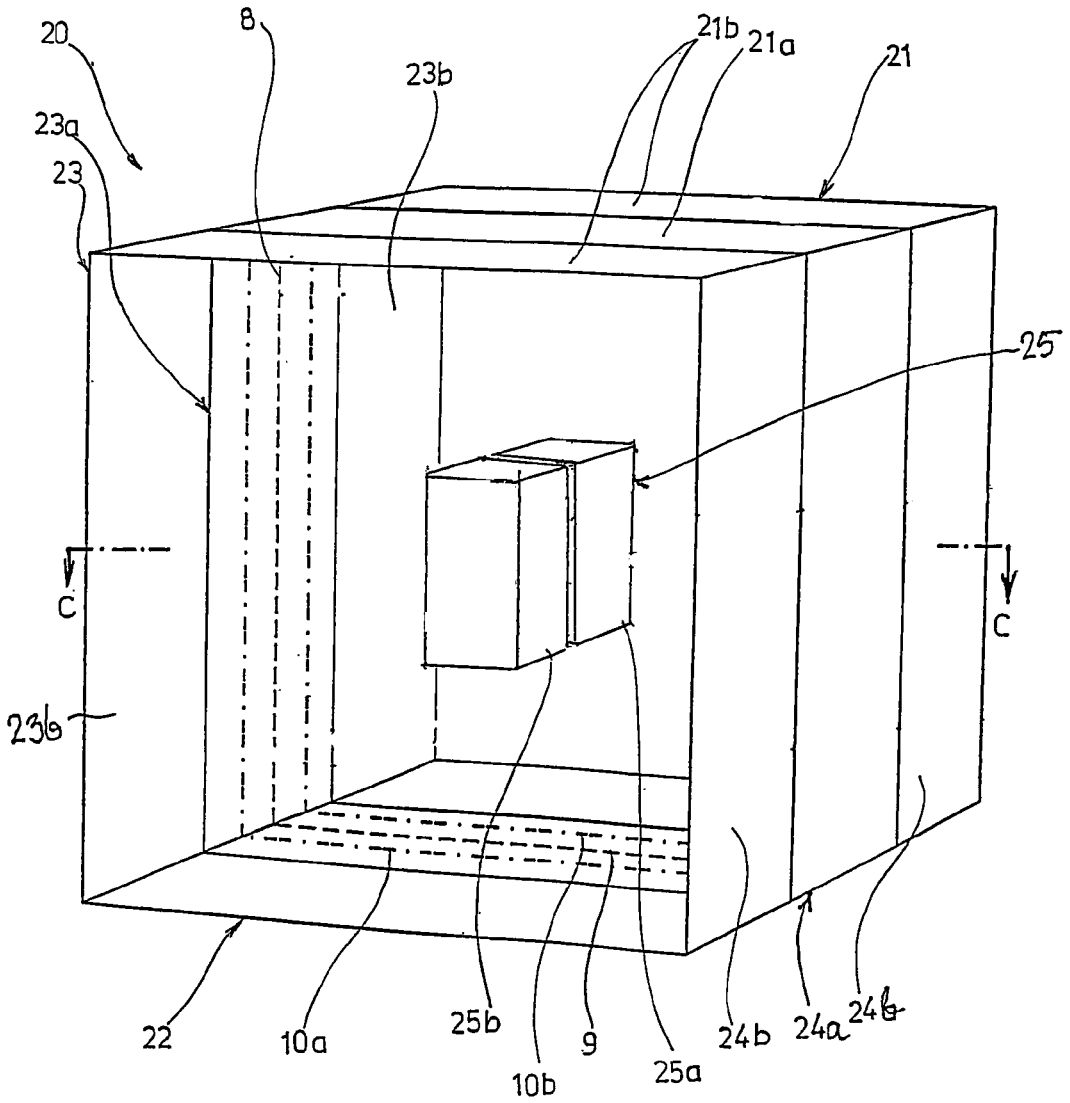
FIG. 6 shows the perspective view of a further construction of the equipment.
Figure 7:
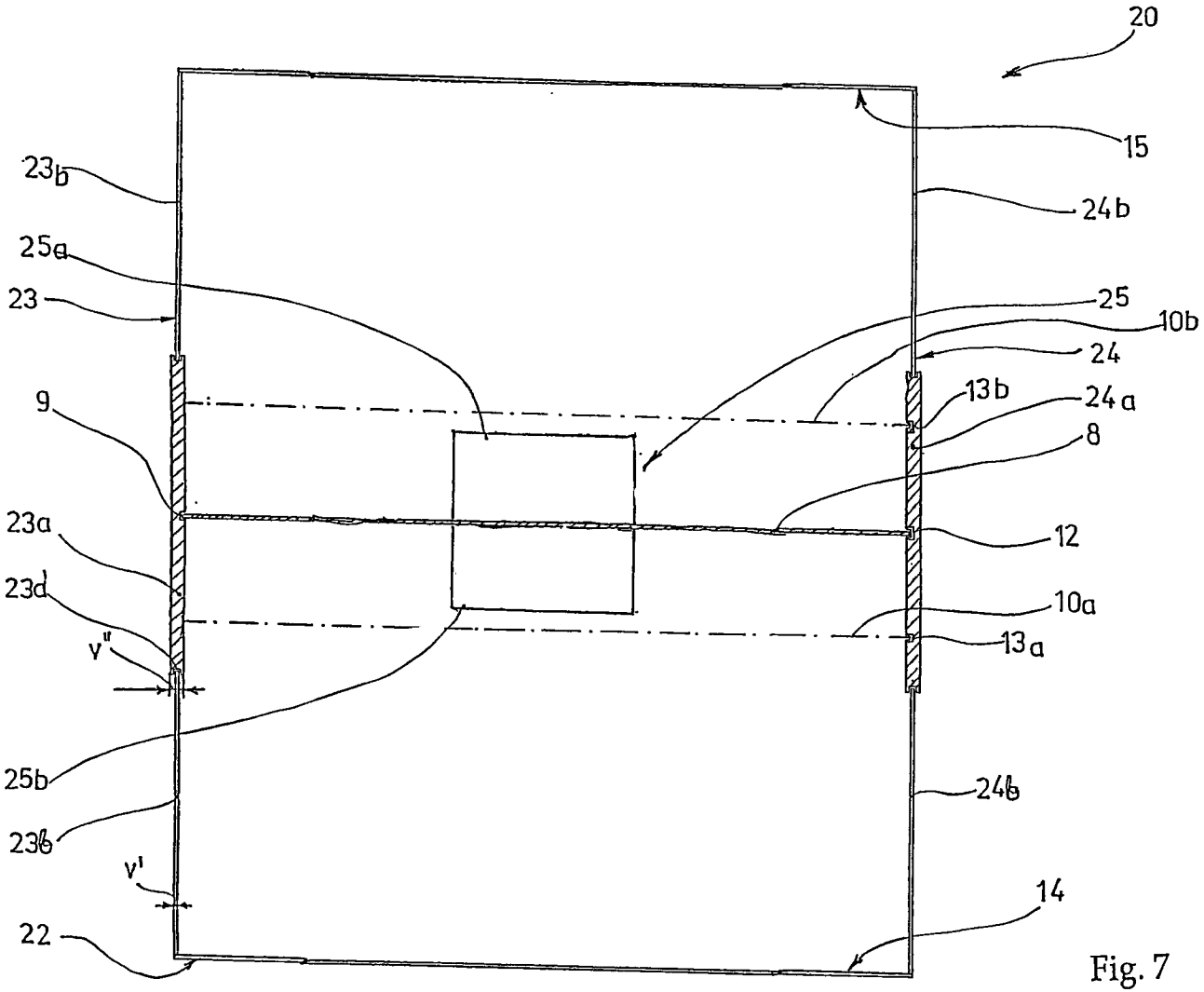
FIG. 7 shows the horizontal section taken along line C-C marked in FIG. 6.

Basically the difference between the construction of the equipment shown in FIGS. 6 and 7 and the one shown in FIGS. 1-5 is that its side walls, its top and—in a given case—its bottom are only partly made of a non-transparent material, which, in a given case, may make the artificial illumination of the internal space unnecessary. For this reason, in FIGS. 6 and 7 the elements already described above, such as the strips 9, 10*a*, 10*b*, the transparent plate 8 and the grooves 12, 13*a*, 13*b* are marked with the reference numbers used in FIGS. 1-5, while the chamber or cabinet is marked with reference number 20 as a whole. The side walls 23, 24 of the chamber 20 consist of three parts: central wall-parts 23*a* and 24*a*, which are made of a non-transparent material similarly to the entire bottom 22, in other words: base plate, and the central top-part 21*a* of the top 21, which, in horizontal position, falls in the continuation of the vertical wall-parts 23*a*, 24*a*.

On two sides extreme wall-parts 23*b* and 24*b* join the wall-parts 23*a*, 24*a* of the side walls, which extreme wall-parts are practically of the same v thickness as the wall-parts 23*a*, 24*a* and are made of a material, which is not clear as water or transparent, but rather translucent, e.g. plastic of this nature or glass made mat by sand milling. Favourably the wall-parts 23*b*, 24*b* should be of the same length, which may be the same as the length of the central wall-parts 23*a*, 24*a*. Obviously the entire walls 23, 24 are of the same permanent height.

As it can be seen in FIG. 7, in this case the strips 9, 10*a*, 10*b* producing the illusion of floating are created as grooves 12, 13*a*, 13*b*, which run continuously along the internal surface of the wall-parts 23*a*, 24*a*, the lower surface of the top 21 and the upper surface of the bottom 22. In this case too the transparent plate 8 is caught in the central groove 12 as described in connection with FIGS. 1-5—three grooves are used in this case too—, and according to this example too an information carrying device or unit marked with reference number 25 as a whole consisting of two identical half-parts, that is objects 25*a*, 25*b*, is displayed in the chamber 20, which the objects 25*a*, 25*b* are fixed, e.g. glued, to the two opposing sides of the transparent plate 8 completely overlapping each other. Obviously the objects 25*a*, 25*b* can also be attached to the transparent plate 8 as shown in FIG. 5, e.g. with the help of a pin or pivot.

It is pointed out here that the version of the equipment shown in FIGS. 6 and 7 is favourably used in cases, when large information carrying units are displayed. In this case the chamber or cabinet 20 may even be as tall as a person or even taller, with a width suiting its height. In this case the ambient light, either natural or artificial light, by itself may be sufficient for illuminating the information carrying device 25, which can be made appropriately visible by the light passing through the translucent wall-parts 23*b*, 24*b* and the top-parts 21*b*. Obviously it is also possible to use light sources arranged in the peripheral range of the openings 14, 15 on the front side (see FIGS. 1 and 2) or elsewhere in the chamber 20, making sure that they do not result in reflections from the transparent plate 8 and at the same time excellently illuminate the information carrying unit 25. In this case too, favourably invisible glass plate should be used as the material of the transparent plate 18.

Reinforcement may be necessary in the case of large chambers with a rectangular base, which may be solved with frames formed by frame-members running along the edges.

Generally, large chambers have a display units consisting of large objects. As it has been pointed out above, in the interest of enhancing the efficiency of advertising favourably the mobility of the currently used display unit should also be ensured, which can be achieved either by moving the transparent plate e.g. with a friction wheel or with the help of motors built in the objects forming the unit (see the description relating to FIG. 5). If a large display unit needs to be moved, besides the motor practically a rack mechanism should also be built in it, which, even when it is connected to a relatively low-performance motor, makes it possible to move large objects.

Figure 8:
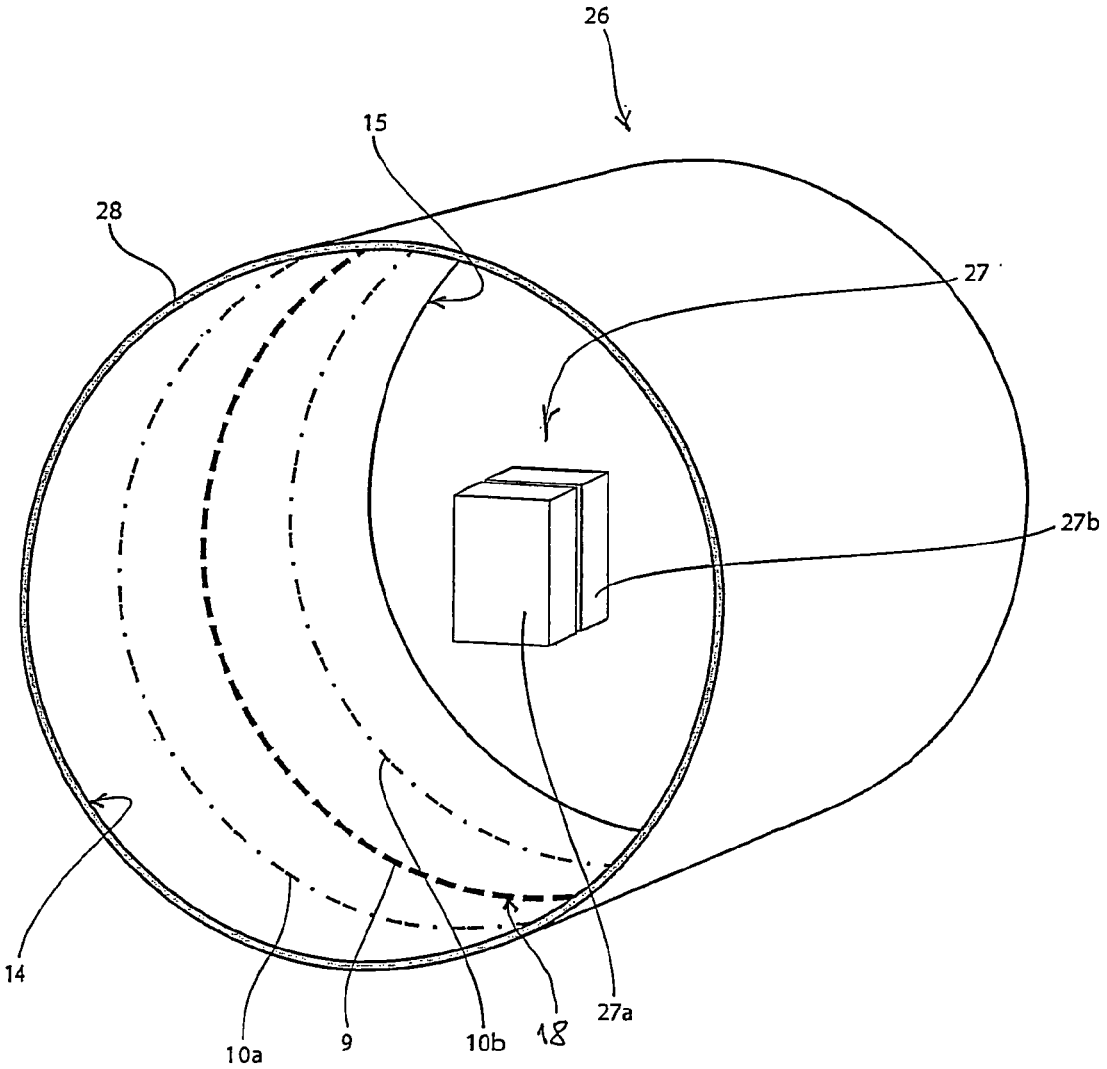
FIG. 8 shows the perspective view of a further construction of the equipment according to the invention.
Figure 9:
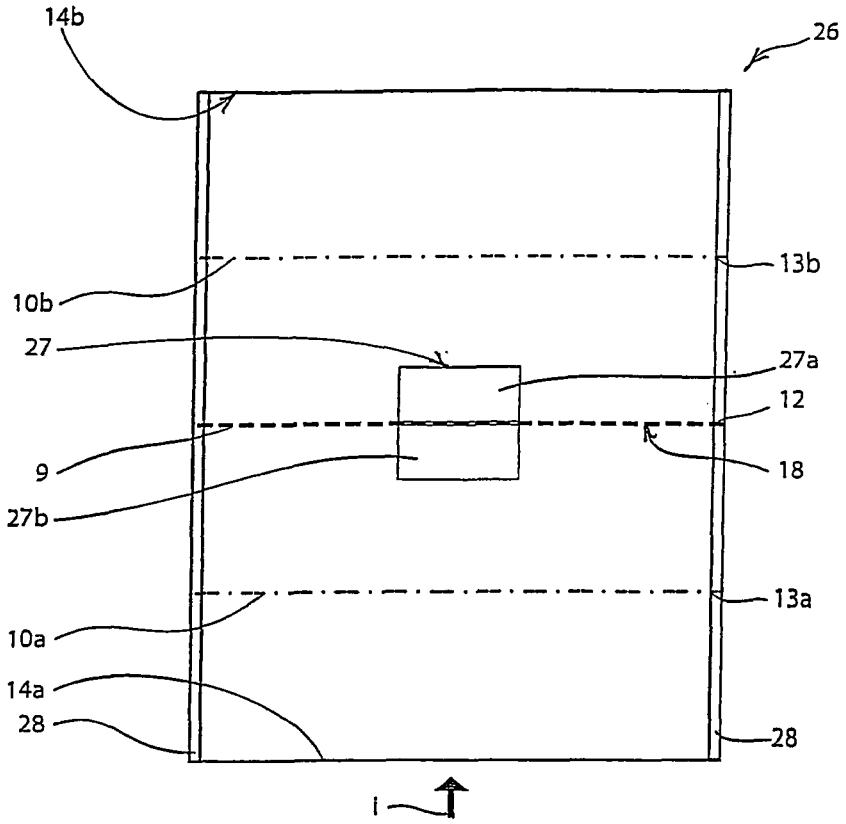
FIG. 9 shows the section taken along line F-F marked in FIG. 10.
Figure 10:
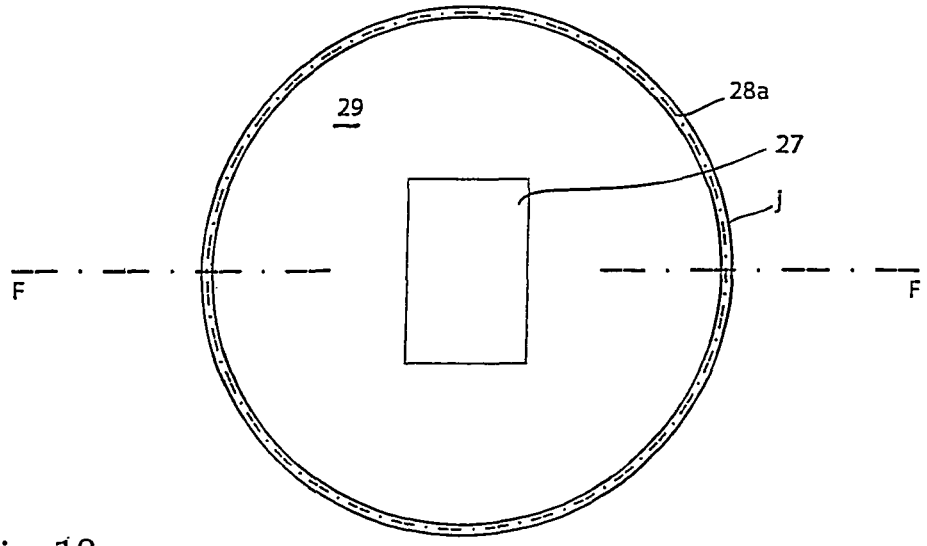
FIG. 10 shows the section viewed from the direction of arrow i marked in FIG. 9.
Figure 11:
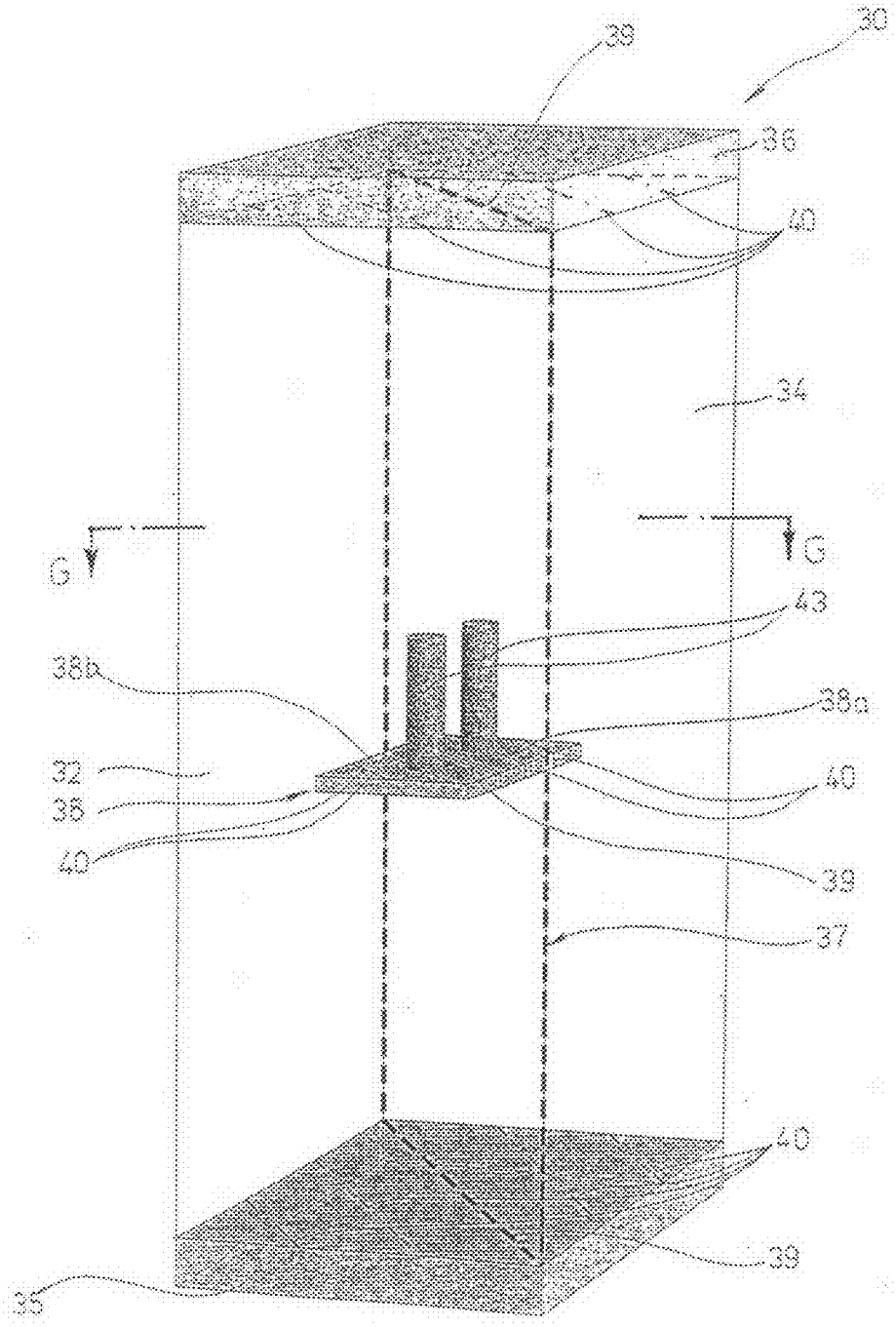
FIG. 11 shows a further construction of the equipment in perspective view.

In the case of the equipment shown in FIGS. 8-10 the information carrying unit marked with reference number 27 in this case can be viewed inside the chamber 26 from the front and from the back, that is from two sides, through the openings 14, 15 on the front side, and in this case too it is formed by objects 27*a*, 27*b* fixed on two opposing sides of the transparent plate 8 as shown in FIGS. 1-5, see especially FIG. 3 of a larger scale. The difference between this equipment and the one shown in FIGS. 1-5 is that in this case the chamber 26 has the shape of a circular cylinder, so its walls namely its delimiting wall 28 is ring-shaped in its cross-section, and here the strips 9, 10*a*, 10*b* are formed by grooves 12, 13*a*, 13*b* only represented by small lines each, and the transparent plate 8 fits into the central groove 12 as shown in the section in FIG. 4 at a larger scale, obviously with the difference that the wall 28 is curved. A further difference as compared to the solution shown in FIGS. 1-5 is that the illumination of the internal space 29 of the chamber 26 is realised with light sources built into the wall 28 made of a translucent material or having a coating of such material on its internal surface, along line j shown in FIG. 10, all around. Obviously the information carrying unit 27 is perceived by the viewer looking inside the chamber 26 from any direction as a floating object.

The construction example of the equipment according to the invention show in FIGS. 11-14 is different from the ones described above in that in this case it is possible to look inside the chamber 30 square-shaped in top view from all directions, as its side walls 31, 32, 33 and 34 are made of a transparent material, favourably glass or plastic of this nature. At the bottom the internal space of the chamber 30 is delimited by a bottom 35 made of a non-transparent material, while at the top it is delimited by a top 36 made of the same material. The lateral top-parts 21*b* of the top 21 can be made of the same material, and favourably their width should be the same as that of the wall-parts 23*b*, 24*b*, which is the same as the width of the central top-part 21*a*. In this case too a criterion of the invention of basic significantly is that a transparent plate 37—marked with a bold dotted line in FIGS. 11 and 12—favourably non-reflecting, is built in the internal space of the chamber 30, and shelf-members 38*a*, 38*b* completely overlapping each other are fixed to it, one on each opposing side, together producing the illusion of a floating shelf 39 rectangular in top view, as shown separately in FIG. 14 together with a part of the transparent plate 37 at a larger scale. In this case too an essential condition of producing the illusion that the shelf 38 is floating is that parallel to the strip 39 appearing due to the fact that contact is realised at the place where the shelf-members 38*a*, 38*b* and the transparent plate 37 and where the transparent plate 37 and the bottom 35 or the top 36 meet each other, similar strips 40 must run on the two sides, as in this way the perfect illusion of a floating shelf 38 can be produced. As it can be seen especially well in FIG. 14, in this case too the strips 40 parallel to the strip 39 created as a result of the contact created by the transparent plate 37 are formed by grooves 41.

Figure 13:
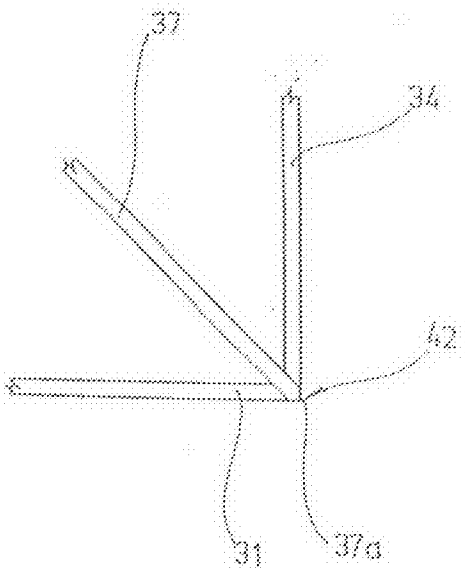
FIG. 13 shows section K marked in FIG. 12, at a larger scale.
Figure 12:
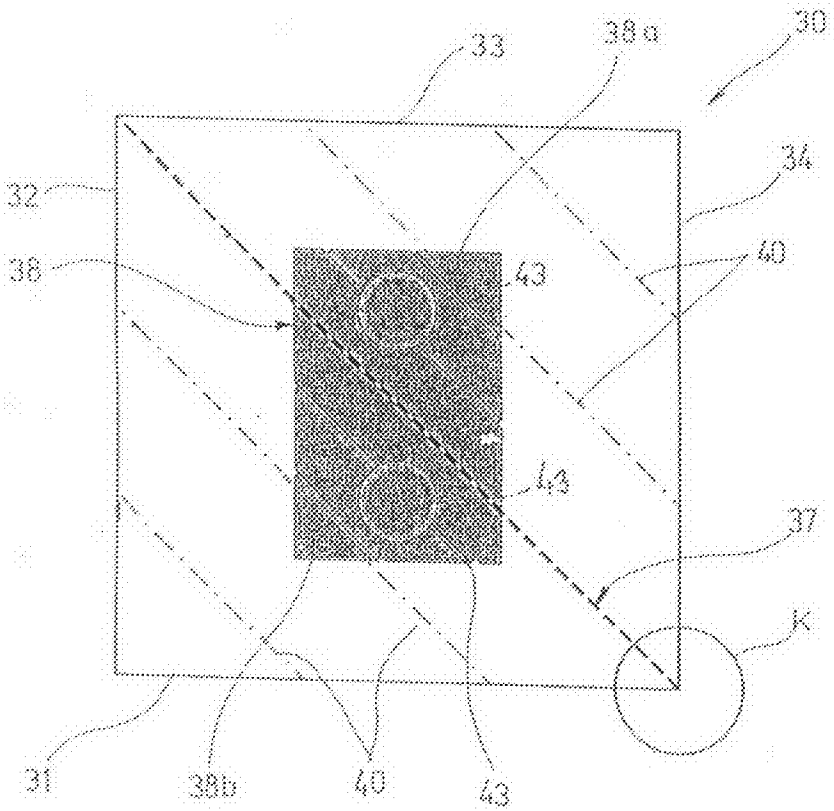
FIG. 12 shows the horizontal section taken along line G-G marked in FIG. 11.
Figure 14:
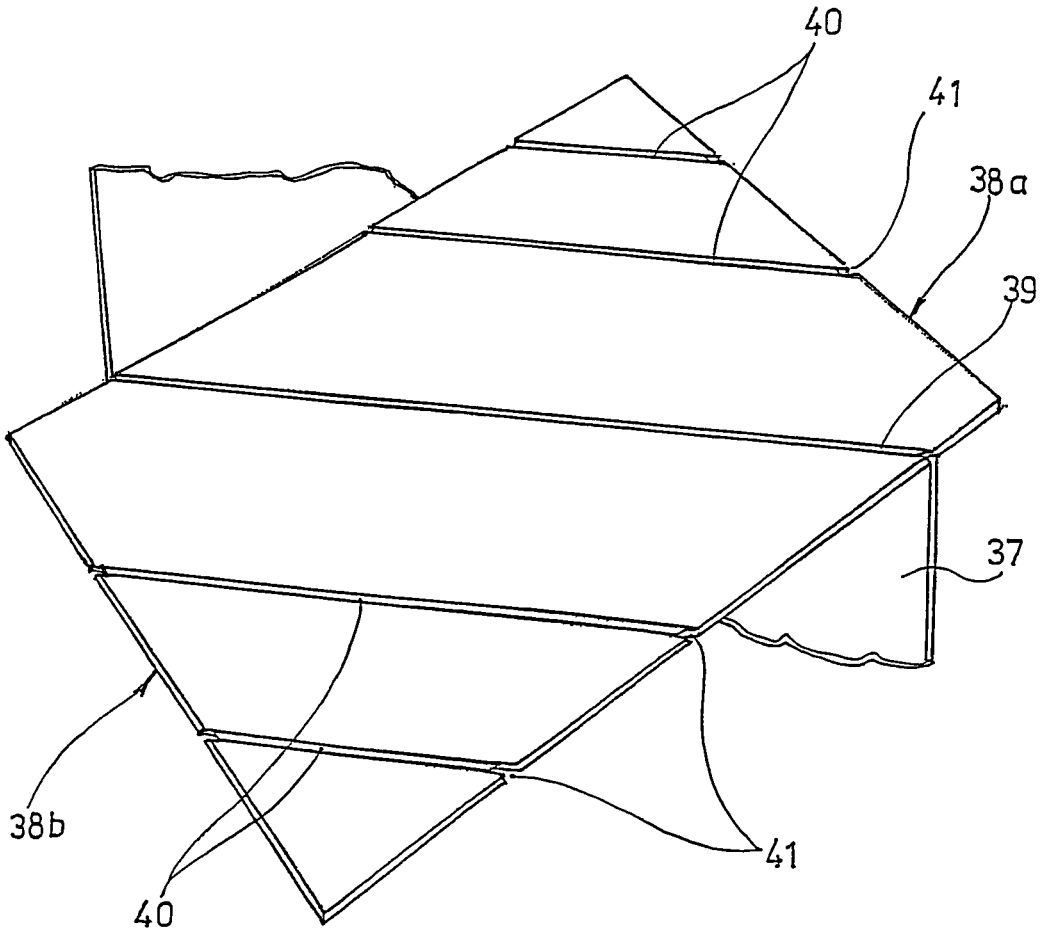
FIG. 14 shows a favourable construction of the shelf shown in FIG. 12, at a larger scale.

In FIG. 13 it is shown how the vertical edge 37*a* of the transparent plate 37 contacts the vertical edges 31*a*, 34*a* of the neighbouring side walls 31, 34. As in this case a thick strip 42 is created due to the meeting of the edges, the viewer does not guess at all that a diagonal transparent plate is also part of this contact, so a perfect illusion is produced in this respect too. The products to be displayed placed on the shelf 38 are marked with reference number 43. They are situated on two sides of the transparent plate, but viewers have the impression that they see two products 43 e.g. vases, jewels, etc., next to each other on the same shelf. It is also pointed out that several similar "floating" shelves can be arranged in the chamber—glass cabinet—above or below each other.

Figure 15:
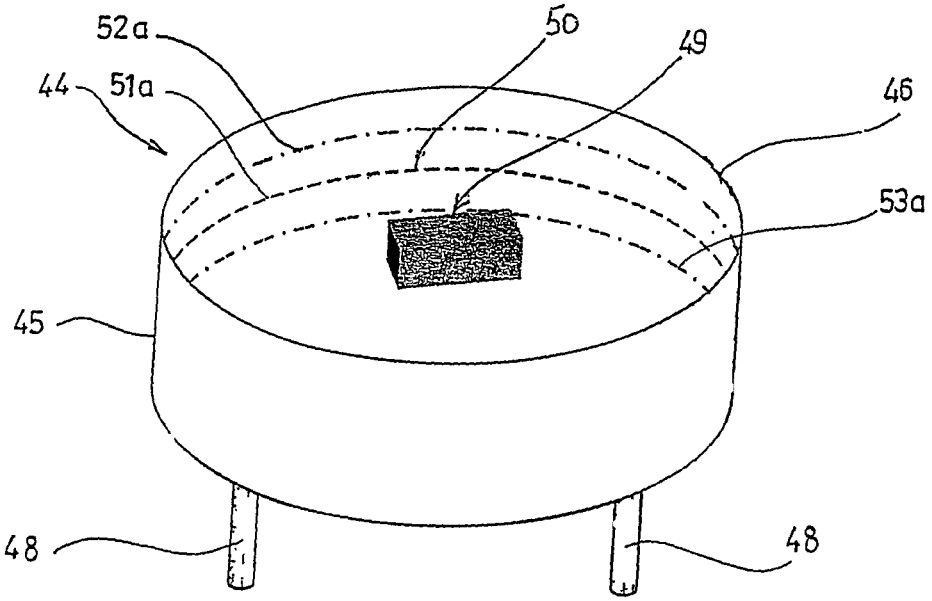
FIG. 15 shows another version of the equipment according to the invention, in perspective view.
Figure 16:
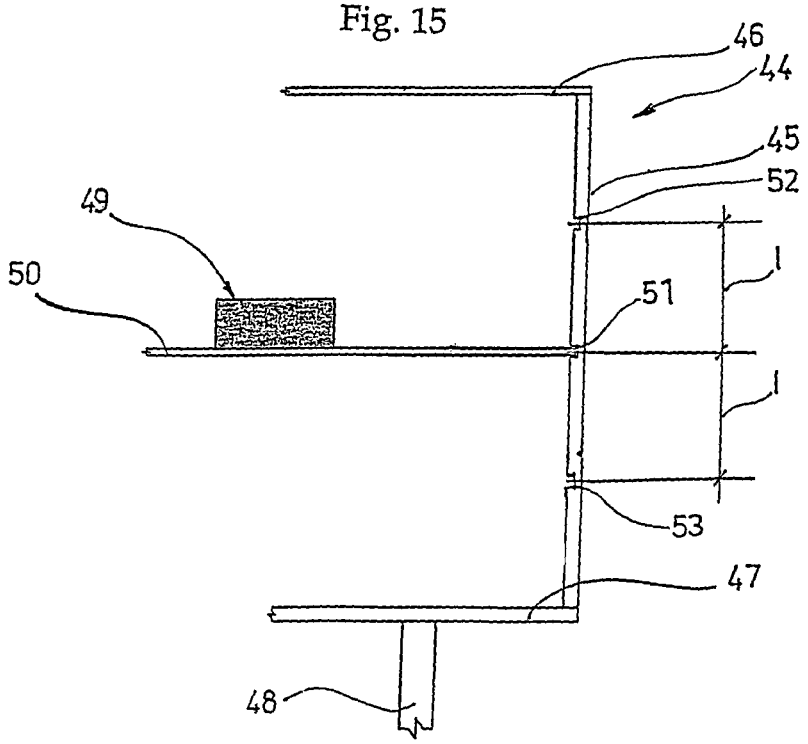
FIG. 16 shows the cross-section taken across the vertical geometrical axis shown in FIG. 15.

In FIGS. 15 and 16 a version of the equipment is shown with a chamber of the shape of an upright cylinder, marked with reference number 44 as a whole, and it is open at the top or in a given case it is closed with a top 46 of a transparent material, and at the bottom the non-transparent cylindrical side wall 45 is closed with a bottom 47 also made of a non-transparent material. The chamber 1 stands on legs 48, and it is used for displaying information carrying devices 49, especially objects to be advertised, which need to be viewed by looking at them from the top downwards, that is the upper edge of the chamber 44 is situated at a height somewhere between the knees and waist of an adult person. In this case too the information carrying device 49 must seem to the viewer as if it was floating, which is ensured in the same way as in the solutions according to the examples described above, that is a circular disc shaped transparent plate 50 is built in the side wall 45 of the chamber 44 at right angles to its generatrices, in horizontal position. The transparent plate 50, which is favourably made of invisible glass, is caught into the groove 51 running around, so in this way the person looking inside the chamber 44 sees a strip 51*a* where the side wall 45 and the groove contact each other, without perceiving the transparent plate 50 itself. In order for the viewer having the illusion that the information carrying device 49 placed on the transparent plate 50 is a floating object, further grooves 52, 53 below and above the groove 51, at least one on each side, must be created running at an l distance from the groove 51, which grooves 52, 53 appear for the viewer as strips 52*a*, 53*a* identical to strip 51*a*, marked in FIG. 15 with a dotted line, making the transparent plate 50 quasi "invisible" and producing the illusion that the information carrying device 49 to be advertised is floating.

It is pointed out here that the chamber 45 can also have the shape e.g. of an elliptic cylinder, and it does not need to have a bottom, it can be erected on an already existing base or a base constructed for this purpose, obviously of appropriate quality, and basically the transparent top 46 is needed to prevent unauthorised access to the inside of the chamber 44. It is also possible to use chambers of a different base, e.g. a tetragonal or polygonal base.

A further favourable version of the equipment according to the invention is described in detail on the basis of FIGS. 17-20. This version has a chamber 30 as shown in FIGS. 11-14, where it is possible to look inside from all sides—but at least from two sides—so the elements described above are marked in FIGS. 17-20 with the same reference numbers. The basic difference as compared to the equipment shown in FIGS. 11-14 lies in that here in the transparent plate 37 there is an opening 54 with a frame 55 running along it. This frame 55 consists of two frame-members 55*a*, 55*b* situated on two sides of the transparent plate 37 exactly overlapping each other. It can be seen in FIG. 19 at a larger scale that the frame 55 of k thickness overlaps the edges of the transparent plate 39 at a k' distance, so the edges of the transparent plate 39 are covered when viewed from the direction of the opening 54. In this case the effect mechanism described above in detail is realised here too, as the viewer sees the frame 55 floating, and it forms a supporting device for the information carrying device 56 to be displayed, e.g. the object to be advertised. In the present case this object 56—that is the information carrying device—is fixed with a pin 57 fixed in the transparent plate 37, e.g. glued in a bore-hole, between the lower frame sides of the frame-members 55*a*, 55*b*, but the object can also be simply placed on the lower frame-part of the frame 55, or it can be suspended e.g. with a piece of thread, chain or something similar on the upper frame-part of the frame 55, or it can be fixed with the help of pins protruding from the sides, or with one single pin like a bracket. As the viewer finds that the frame 55 of the equipment is the floating element, several different objects can be placed within the frame 55 in different ways, and so the efficiency of advertising can be increased significantly.

In compliance with the detailed description above, in order to produce the illusion that the frame is floating, both the lower surface of the top of the chamber 30 and the upper surface of the bottom must contain diagonal strips, favourably grooves, parallel to the plane of the transparent plate 39, as it is shown in FIGS. 11-14.

On the basis of FIGS. 17-20 and the explanations relating to them it is also obvious that in the case of the construction examples or versions according to FIGS. 1-5, FIGS. 6-7, FIGS. 8-10 and FIGS. 15, 16 the opening 54 with a frame as shown in FIGS. 17-20 can be created easily, and the current information carrying device can be attached to this frame as a supporting device. A person skilled in the art also finds it obvious that in the case of each equipment that can be viewed from two directions or from above as described in the examples above, besides the information carrying device placed in such a framed opening, other information devices consisting of parts fixed to the two opposing sides of the transparent plate overlapping each other as described above can also be arranged in practically optional configurations.

Figure 21:
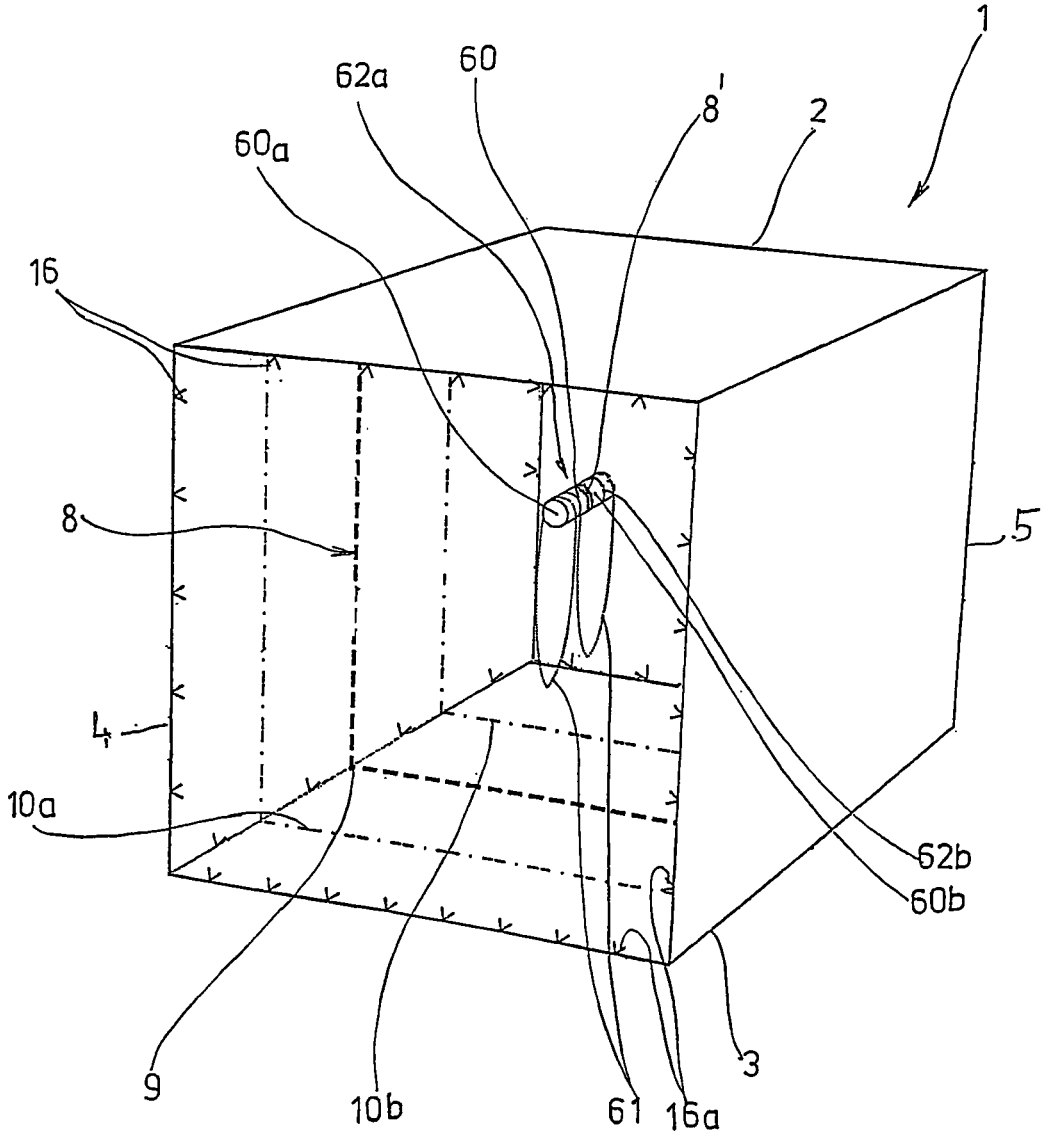
FIG. 21 shows the construction of the equipment shown in FIGS. 1-4, in perspective view.
Figure 22:
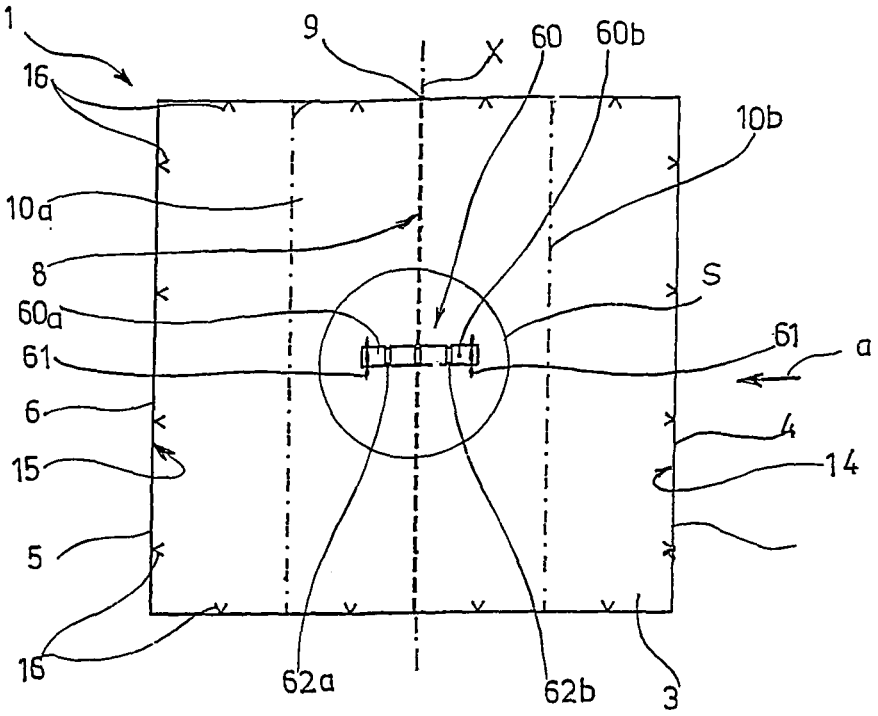
FIG. 22 shows the equipment as in FIG. 21, in top view, with the top of the chamber removed.
Figure 23:
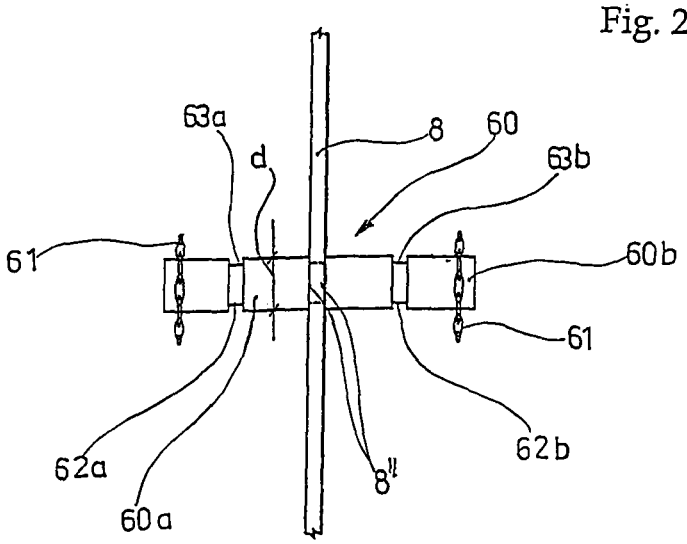
FIG. 23 shows section S marked in FIG. 22 separately, on a greater scale.

The construction of the equipment shown in FIGS. 21-23 relates to a solution where the only difference as, compared to the equipment shown in FIGS. 1-4 is that here it is not the objects 11*a*, 11*b* forming the information displaying device 11 that are fixed to the transparent plate 8, but the cylindrical supporting members 60*a*, 60*b* of a supporting device 60, which members—as opposed to the shelf-members 38*a*, 38*b* producing the illusion of a floating shelf 38 as shown in FIGS. 11-14—together produce the illusion of a floating cylindrical rod-shaped supporting body for the viewer looking inside the chamber 1 from any side, on which information carrying devices to be advertised, such as necklaces or similar objects are suspended. In order to produce the illusion of floating, the supporting members 60*a*, 60*b* must fit on the two sides of the transparent plate 8 so that they exactly overlap each other, as it can be seen in the figure at a larger scale, where the—obviously identical—diameter of the supporting members 60*a*, 60*b* having a circular cylindrical cross-section is marked with reference letter d and the contact surfaces are marked with reference number 8". In order to create the illusion that the supporting device 60 is floating, the supporting members 60*a*, 60*b* situated on the two sides of the transparent plate 8 also need to contain strips running parallel to the line of the contact surfaces 8", that is to the planes of the transparent plate, which strips are marked with reference numbers 62*a*, 62*b* in FIGS. 21-23, and in this case, as it can be seen in FIG. 21 at a larger scale, they are favourably formed by grooves 63*a*, 63*b*, similarly to the earlier construction examples. It is pointed out here that apart from the replacement of the information displaying element 11 shown in FIGS. 1-4 with a supporting device 60, the equipment shown in FIGS. 21-23 suits the equipment shown in FIGS. 1-4 in respect of the construction and illumination of the chamber 1 (light sources 16*a*) and its use, so in FIGS. 21-23 the same reference numbers are used to mark the same elements.

Figure 24:
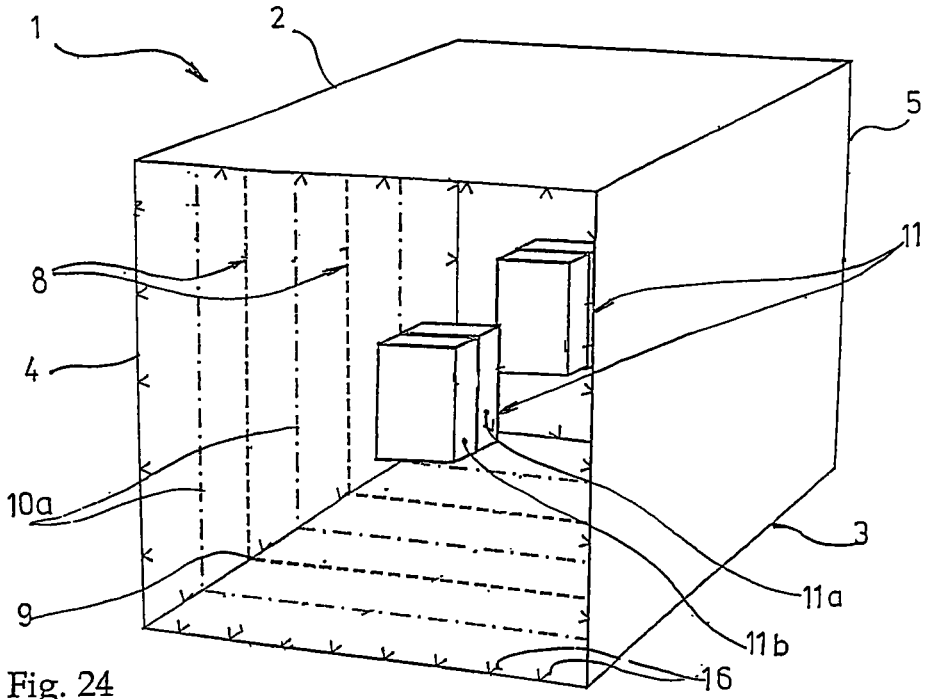
FIG. 24 shows a further embodiment of the equipment in perspective view.
Figure 25:
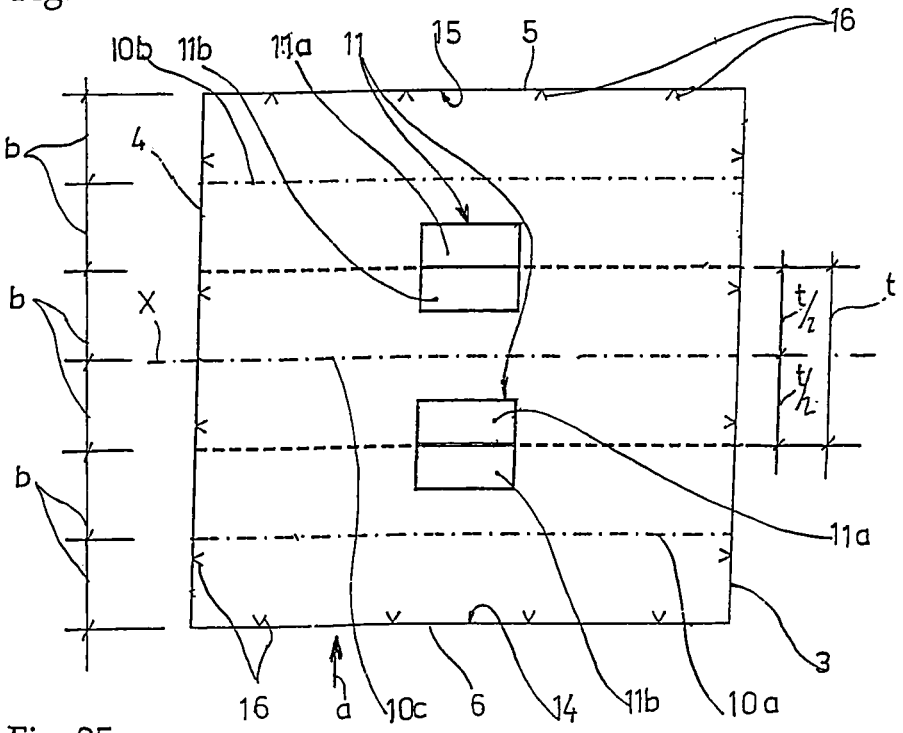
FIG. 25 shows the equipment according to FIG. 24 in top view, with the top removed.

FIGS. 24 and 25 show an embodiment similar to that shown in FIGS. 1-5, therefore, we have naturally used the reference numbers and letters used in them to indicate the same structural elements in FIGS. 24 and 25 as well. The difference lies in that in the equipment according to FIGS. 24 and 25 there are two transparent plates 8 built into the chamber 1 at a distance t from each other, parallel to the vertical central plane X, at a distance to the two sides of it of t/2. In this case apart from the strips 10*a*, 10*b* running at a separation b there is also a central strip 10*b* established in the vertical central plane X, in this way the connection strips 9 of the transparent plates 8 joining them to the walls 2-5 remain completely unnoticeable to the viewer. We note that in all other respects, e.g. groove formation, fitting or arrangement on the axis, rotational, material choice, etc. FIGS. 1-5 and that stated in connection with them is obviously valid with regards to the embodiments according to FIGS. 24 and 25 as well. The equipment according to FIGS. 24 and 25 is advantageous because several transparent plates 8 offer the possibility to advertise several types of product at the same time in the same chamber 1, located at various spatial depths. Besides this, the efficiency of the advertising may be increased through the separate movement, e.g. rotation, of the various devices 11, even with the one product being at rest while another is rotating, or the product is moved in any direction through the movement of the transparent plate 8, e.g. shifted.

Figure 17:
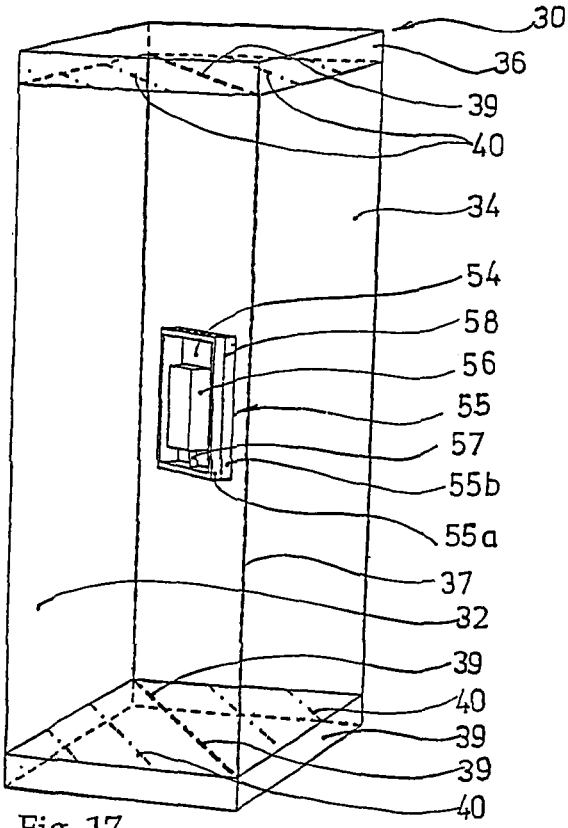
FIG. 17 shows a further construction of the equipment according to the invention in perspective view.
Figure 20:
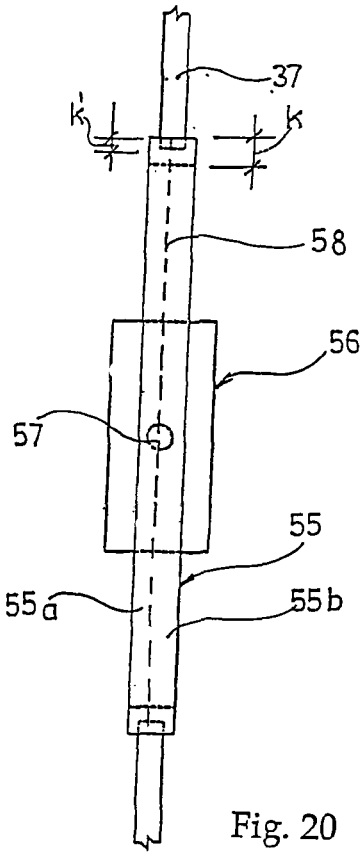
FIG. 20 shows the central part of FIG. 18 at a larger scale.
Figure 18:
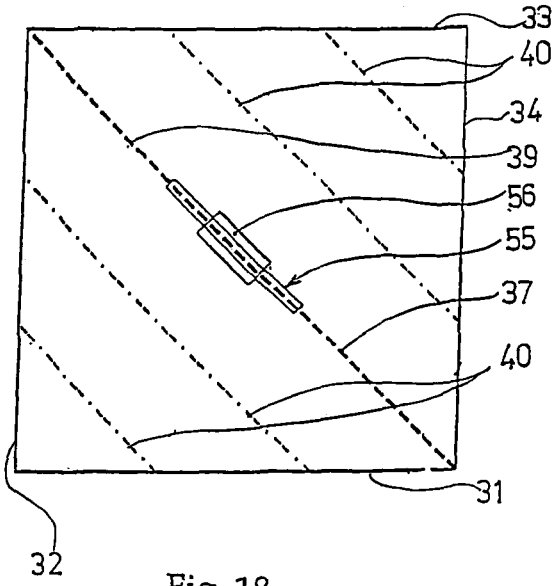
FIG. 18 shows the chamber as in FIG. 17, in top view, with the top removed.
Figure 19:
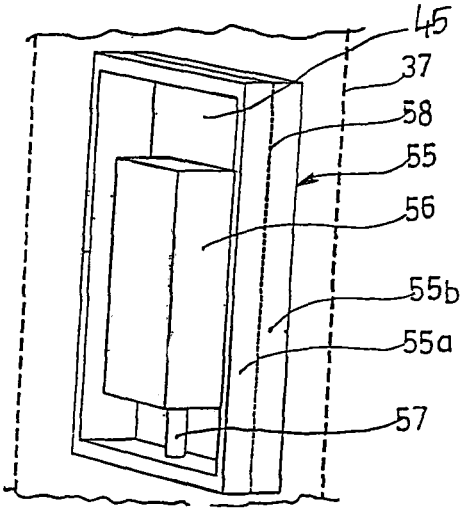
FIG. 19 shows the central part of FIG. 17 at a larger scale.

In FIGS. 27 and 28 we have illustrated an embodiment similar to that according to FIGS. 11-14 in that here a three-dimensional star-shaped product 69 to be advertised is displayed inside the chamber 70 placed on a seemingly floating shelf 78. Primarily, the difference is that not only the side walls 71-74 of the chamber 70 according to the equipment according to FIGS. 27 and 28 are of a transparent material but the bottom 75 and top 76 are transparent as well, on the other hand, here the transparent plate 77 runs at an angle inside the chamber 70 starting from the corners or edges 78, 79 opposite one another at the bottom and at the top and finishing in them, and on the two sides, fitting in the grooves made in the side walls 71, 73, which fitting lines appear as strips 77'. The corner connections may be formed in accordance with FIG. 13, therefore, they seem visually hidden to the viewers. Here the product 69 is supported by a body functioning entirely as a shelf 78, which is formed by two identical triangular-based, prism-shaped shelf-members 78*a*, 78*b*, which are positioned opposite one another on the two sides of the transparent plate 77 and the product 69 rests on the shelf-member 78*b*. In this way, in the case of this solution the strips 80 formed as grooves, for example, in the side walls 71, 73 or on the side walls serve to make the strip 77' that also goes through the shelf 78 "invisible", parallel to which the strips 80' also appear on the side surface of the shelf-members 78*a*, 78*b*. These strips 80, 80' are perpendicular to strips 77', as a result of which the latter seem to be visually hidden from the viewer, as, at the maximum, the viewer sees these strips 77', 80 as pattern elements. The advertising of certain goods or products may be increased using the equipment according to the invention using lighting technology or illumination effects. As, however, if the walls of the chamber are not opaque or transparent as mentioned in the examples mentioned till now, but from translucent material such as onyx, matt glass, translucent plastic, etc., we may position the light sources on the external side of the chamber walls, in other words, viewing from inside behind the chamber walls—either the side walls or even the top and/or bottom—, for example LEDs, which have advantageous characteristics from numerous respects (small space requirement, do not get hot, etc.), as so the internal space of the chamber can be perfectly illuminated, seemingly "secretly", which makes the illumination of the product to be advertised with a separate light source unnecessary, as it receives light all around, homogenously. Apart from this, using this illumination technique the reflection projected onto the transparent plate supporting the product can be reduced to a minimum as the light extinguishes it. In the case of such illumination the advertising technique according to FIGS. 17-19 is especially effective, where the cut out part of the transparent plate is encompassed by a frame and in it an object is placed because reflection does not appear.

In FIGS. 28-30 a structure can be seen with the help of which in a chamber of the equipment the display of the strips parallel to the fixing strips of the transparent plate 8 supporting, here, a star-shaped product 69 does not take place with the grooves presented in FIG. 4, for example, but through the fitting grooves, indicated with reference number 91 in FIG. 30, of the thin-walled frame elements 90 clamped up against one another and fed into or pushed into the chamber—not separately illustrated here. The strip formation operation is performed, as illustrated in FIG. 29, by that the frame elements 90 are inserted one after the other into the chamber of the given equipment with walls made of, for example, opaque material from two sides towards the transparent wall 8 positioned in the middle in accordance with the arrow marked with a u in such a way so that the two internal frame elements 90 with their surrounding internal edge completely fit onto the transparent plate 8, then so that the internal edges of the two external frame elements 90 fit onto the external edges of the internal frame elements 90 with a gap. It is in this way that the wall surface shown on FIG. 30 with the "floating" product 69 in front of it is formed. So in this case—as opposed to the solution described in connection with FIGS. 1-5—the strips 91 are not formed as grooves, by, for example, carving into the wooden chamber wall, but these strips 91 are formed by the fitting gaps of the frame elements 90 when fitted up to the transparent plate 8 and each other. As a result of this the width of the groove 92 in which the transparent plate 8, especially glass plate, fits with its edges is optically reduced to a minimum, seemingly being optically "contracted". For example, in the case of a glass plate with a width of 3 mm only a hair-thin strip 93 will be visible, and this solution "tricks" the eye in an exceptionally favourable way, as the strips along the glass plate seem so thin so that in all probability no one would think that there is a glass plate along this strip 93 where the transparent plate fits into the groove. This width of the other strips 91—the width of the fitting grooves between the frames 90—can be adjusted to the width of the strip 93, so the strips 91 on the internal surfaces of the chamber appear as hair-thin lines. Therefore, with the help of the structure according to FIGS. 28-30 it is possible to make the fitting gaps of the frames to optically disappear almost completely. The cross section of the frame elements 90 can be quadrangular, rectangular, multi-sided, curved or even amorphously shaped. We note that the material of the frames can be essentially selected as required, in accordance with the current application objective, and their walls thickness can be selected taking practical aspects into consideration.

It is clear that the strip-formation solution according to FIGS. 28-30 can also be applied in the case of all the embodiments in FIGS. 1-30 and in the cases of other embodiments as well.

As compared to the advertising equipment based on producing the illusion of floating and known earlier, the advantage of the invention lies in that it is possible to look inside the chamber from two or even from four sides, and it is possible to walk around the chamber, as a result of which the efficiency of advertising increases significantly. The efficiency of advertising can be increased by moving the information displaying device/supporting device indirectly or directly, with a motor built in the objects or by rotating and/or shifting the entire transparent plate up and down or in a lateral direction, using a friction disc or rack or other mechanism. Furthermore, the efficiency of advertising can be increased by fixing several information displaying devices and/or supporting devices on the same transparent plate.

Obviously the invention is not restricted to the constructions described in detail above, but it can be realised in several different ways within the scope of protection defined by the claims.

The invention claimed is:

1. Equipment for displaying information carriers especially for advertising purposes, which equipment comprises non-transparent chamber walls and transparent end plates together defining a chamber with openings defined by the transparent end plates for accommodating an information carrying device and constructed in a way to make it possible to look into internal space defined by the chamber, and at least one transparent plate in the chamber, transverse with respect to a viewing direction into the chamber, attached to a non-transparent wall of the chamber and in contact with a contact strip in the chamber wall; the information carrying device being situated on the transparent plate; and at least a portion of the non-transparent chamber walls containing strips parallel to the contact strip, the information carrying device being formed by at least two objects which are situated on opposite sides of the transparent plate and images of which seen from a direction perpendicular to the transparent plate are substantially identical.

2. Equipment as in claim 1, wherein distance between each of said openings of the chamber and the transparent plate is sufficient to obstruct view of the transparent plate part at interface between said at least two objects.

3. Equipment as in claim 1, wherein said at least two objects forming the information carrying device are fitted on opposite sides of the transparent plate, or spaced from the transparent plate and fixed to a pin so that said at least two objects can be rotated with a motor in said at least two objects.

4. Equipment for displaying information carriers especially for advertising purposes, which equipment has a chamber for accommodating an information carrying device and constructed in a way to make it possible to look into internal space defined by the chamber, in which chamber there is at least one transparent plate transverse with respect to a direction of viewing into the internal space, attached to a wall of the chamber, and the information carrying device is situated on said at least one transparent plate; and at least a part of the chamber wall contains strips parallel to a contact strip on the chamber wall and in contact with said at least one transparent plate, wherein the information carrying device is formed by at least two objects, said at least two objects being situated on opposite sides of said at least one transparent plate and images of which seen from a direction perpendicular to the transparent plate are substantially identical.

5. Apparatus as in claim 1, characterized by that said at least two objects forming the information carrying device are fitted on opposite sides of the transparent plate, and that the chamber is defined by non-transparent top wall, non-transparent bottom wall, two non-transparent side walls and two transparent end plates.

* * * * *